US006492946B2

(12) United States Patent
Nagumo et al.

(10) Patent No.: US 6,492,946 B2
(45) Date of Patent: Dec. 10, 2002

(54) SURFACE-MOUNTED ANTENNA, METHOD FOR ADJUSTING AND SETTING DUAL-RESONANCE FREQUENCY THEREOF, AND COMMUNICATION DEVICE INCLUDING THE SURFACE-MOUNTED TYPE ANTENNA

(75) Inventors: Shoji Nagumo, Kawasaki (JP); Kazunari Kawahata, Machida (JP); Nobuhito Tsubaki, Shiga-ken (JP); Kengo Onaka, Yokohama (JP); Takashi Ishihara, Machida (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/816,882

(22) Filed: Mar. 23, 2001

(65) Prior Publication Data

US 2001/0040527 A1 Nov. 15, 2001

(30) Foreign Application Priority Data

Mar. 30, 2000 (JP) ..... 2000-094050

(51) Int. Cl.[7] ..... H01Q 1/24
(52) U.S. Cl. ..... 343/700 MS; 343/702
(58) Field of Search ..... 343/700 MS, 702, 343/834, 845

(56) References Cited

U.S. PATENT DOCUMENTS 4,584,585 A * 4/1986 Marko et al. ..... 343/702
5,627,550 A * 5/1997 Sanad ..... 343/700 MS
6,028,561 A * 2/2000 Takei ..... 343/767
6,040,806 A * 3/2000 Kushihi et al. ..... 343/853

* cited by examiner

*Primary Examiner*—Don Wong
*Assistant Examiner*—James Clinger
(74) *Attorney, Agent, or Firm*—Ostrolenk, Faber, Gerb & Soffen, LLP

(57) ABSTRACT

A surface-mounted type antenna which facilitates the realization of the widening of the frequency band, and a communication device including it. In this antenna, the strong electric-field regions of a power supplied first radiation electrode and a power non-supplied second radiation electrode are disposed adjacent to each other with a spacing therebetween, and simultaneously the high current regions of these radiation electrodes are disposed adjacent to each other with a spacing therebetween. By variably adjusting the quantity of the electric-field coupling between the strong electric-field regions of the first radiation electrode and the second radiation electrode, and by variably adjusting the quantity of the magnetic-field coupling between the high current regions of these radiation electrodes, both the quantities of the electric-field coupling and the magnetic-field coupling are set to conditions suited for the dual resonance. A superior dual resonance is thereby achieved.

36 Claims, 14 Drawing Sheets

FIG. 13A
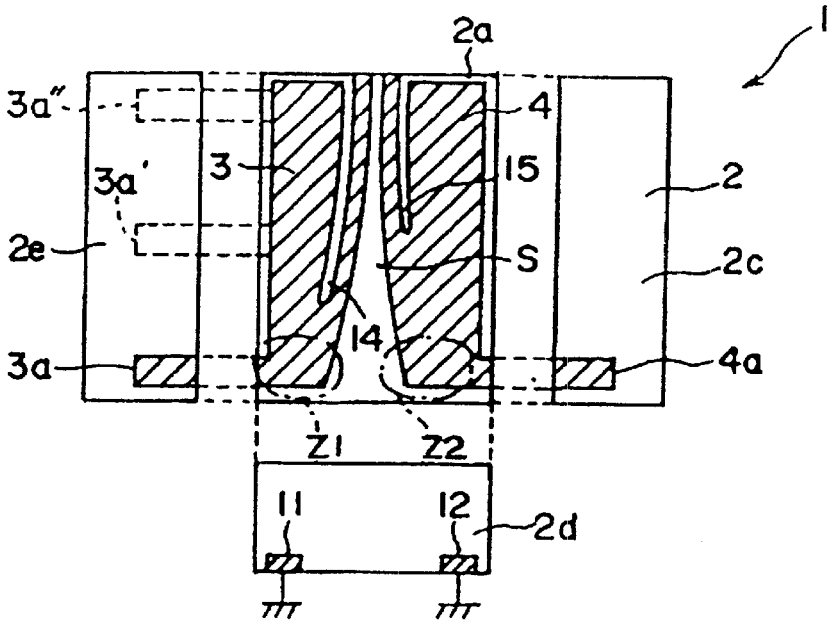
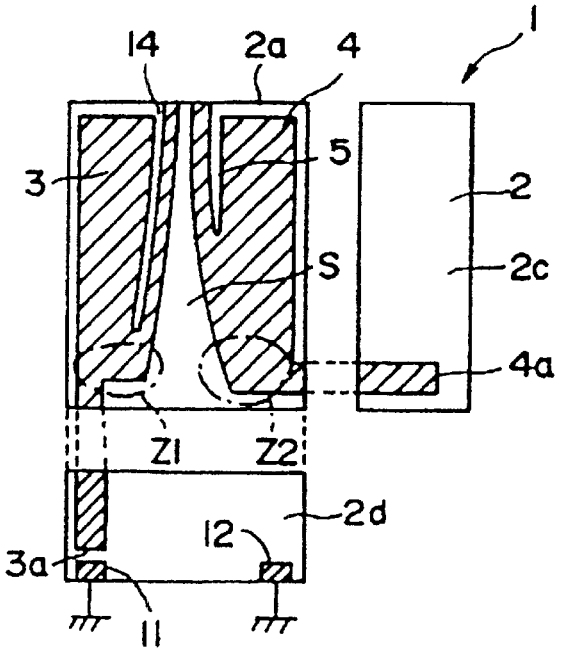
FIG. 13B
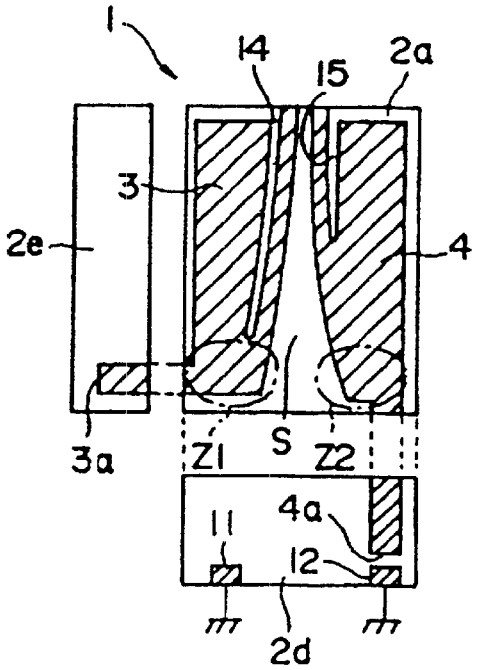
FIG. 13C

SURFACE-MOUNTED ANTENNA, METHOD FOR ADJUSTING AND SETTING DUAL-RESONANCE FREQUENCY THEREOF, AND COMMUNICATION DEVICE INCLUDING THE SURFACE-MOUNTED TYPE ANTENNA

BACKGROUND OF THE INVENTION

1. Field of the Invention

The present invention relates to a surface-mounted type antenna incorporated in a communication device such as a portable telephone, and to a method for adjusting and setting the dual-resonance frequency thereof. The present invention further relates to a communication device including the surface-mounted type antenna.

2. Description of the Related Art

FIG. 17 shows an example of a surface-mounted type antenna. The surface-mounted type antenna 1 shown in FIG. 17 is formed by juxtaposing a power supplied first radiation electrode 3 and a second radiation electrode 4 to which power is not directly supplied on a dielectric substrate 2 having a rectangular parallelepiped shape, with a space (slit) S therebetween. One end side of the first radiation electrode 3 is connected to a power supply portion (power supply terminal) 5, and the other end side thereof constitutes an open end 3*a*. One end side of the second radiation electrode 4 is connected to a short-circuit portion (ground short-circuit terminal) 6, and the other end side thereof constitutes an open end 4*a*.

By connecting the power supply portion 5 to a signal supply source 7 and directly supplying a signal from the signal supply source 7 to the first radiation electrode 3 via the power supply portion 5, and by supplying the signal which has been supplied to the first radiation electrode 3 to the second radiation electrode 4 by an electromagnetic coupling, the first radiation electrode 3 and the second radiation electrode 4 each resonate, thereby performing an antenna operation (operation of signal transmission/reception).

In a surface-mounted type antenna 1 as shown in FIG. 17, by bringing the resonance frequencies of the first radiation electrode 3 and the second radiation electrode 4 close to each other and by causing the resonance waves of the first radiation electrode 3 and the second radiation electrode 4 to create a dual resonance, a widening of the frequency band of signal transmission/reception can be achieved.

A surface-mounted type antenna 1 as described above is required to be miniaturized. In order to achieve the miniaturization thereof, the spacing between the first radiation electrode 3 and the second radiation electrode 4 is narrowed as an inevitable consequence. As a result, the electromagnetic coupling between the first radiation electrode 3 and the second radiation electrode 4 strengthens. This makes it difficult to stably achieve a desired dual-resonance state which allows a required antenna characteristic condition such as the widening of the frequency band to obtained. In order to solve this problem and to stably achieve a desired dual-resonance state, it is necessary to control the electromagnetic coupling between the first radiation electrode 3 and the second radiation electrode 4.

In the surface-mounted type antenna 1 shown in FIG. 17, by adjusting the width of the uniform-width space S between the first radiation electrode 3 and the second radiation electrode 4, the electromagnetic coupling between the first radiation electrode 3 and the second radiation electrode 4 is controlled. However, the control of the electromagnetic coupling using the uniform-width space S is very difficult to execute, and provides a limited degree of flexibility in the design.

The present invention has been made to solve the above-described problem, and aims to provide a surface-mounted type antenna which allows the miniaturization thereof and which is capable of easily meeting a required antenna characteristic condition, and to provide a method for adjusting and setting the dual resonance thereof, as well as a communication device including the surface-mounted type antenna.

SUMMARY OF THE INVENTION

In order to achieve the above-described object, the present invention, in a first aspect, provides a method for adjusting and setting the dual-resonance frequency of a surface-mounted type antenna which includes a dielectric substrate, a first radiation electrode to which power is supplied being formed on the top surface opposed to the mounting bottom-surface of the dielectric substrate, and a second radiation electrode which is juxtaposed with the first radiation electrode on the dielectric substrate with a space therebetween. This method comprises arranging the first radiation electrode and the second radiation electrode so that the strong electric-field regions of the first radiation electrode and the second radiation electrode wherein the electric fields of these radiation electrodes are each the strongest, are adjacent to each other, and so that the-strong electric-field regions of these radiation electrodes thereby come into an electric-field coupling, simultaneously arranging the first radiation electrode and the second radiation electrode so that the high current regions of the first radiation electrode and the second radiation electrode wherein the currents of these radiation electrodes are each highest, are adjacent to each other, and so that the high current regions of these radiation electrodes thereby come into a magnetic-field coupling, variably adjusting each of the quantity of the electric-field coupling between the strong electric-field regions of the first radiation electrode and the second radiation electrode, and the quantity of the magnetic-field coupling between the high current regions of the first radiation electrode and the second radiation electrode, and setting the reflection loss of the dual resonance of the first radiation electrode and the second radiation electrode to a low value not higher than a predetermined value within the range of the set frequency, by adjusting both the quantities of the electric-field coupling and the magnetic-field coupling.

In the method for adjusting and setting the dual-resonance frequency of a surface-mounted type antenna in accordance with the first aspect of the present invention, preferably, the quantity of the electric-field coupling between the strong electric-field regions of the first radiation electrode and the second radiation electrode is variably adjusted, by making variable the spacing between the strong electric-field regions of the first radiation electrode and the second radiation electrode.

Also, in this method in accordance with the first aspect, it is preferable that the first radiation electrode be provided with a capacitance between the open end thereof which is the strong electric-field region thereof on one end side thereof and ground, that a power supply terminal or a ground short-circuit terminal be connected to the high current region thereof on the other end side thereof, while the second radiation electrode be provided with a capacitance between the open end thereof which is the strong electric-field region thereof on one end side thereof and ground, that a ground short-circuit terminal be connected to the high current region thereof on the other end side thereof, and the quantity of the electric-field coupling between the strong electric-field regions of the first radiation electrode and the second radiation electrode be relatively variably adjusted, by variably adjusting the capacitance between the open end of the first radiation electrode and ground, and the capacitance between the open end of the second radiation electrode and ground.

Furthermore, in the method in accordance with the first aspect, it is preferable that the dielectric substrate be formed as a rectangular parallelepiped, and that the capacitive coupling portion between the open end of the strong electric-field region of the first radiation electrode and ground thereof and the capacitive coupling portion between the open end of the strong electric-field region of the second radiation electrode and ground thereof be each formed on mutually different surfaces of the dielectric substrate.

Moreover, in the method in accordance with the first aspect, preferably, the quantity of the magnetic-field coupling between the high current regions of the first radiation electrode and the second radiation electrode is variably adjusted, by making variable the spacing between the high current regions of these radiation electrodes.

Also, in the method in accordance with the first aspect, it is preferable that a conductive pattern be formed which is branched off from the power supply terminal or the ground short-circuit terminal of the first radiation electrode, and which is connected to ground, that a pattern for an inductance component addition be interposed in this conductive pattern, that a current path be formed which leads from the high current region of the first radiation electrode to the high current region of the second radiation electrode via the conductive pattern, ground, and the ground short-circuit terminal of the second radiation electrode, and that the quantity of the magnetic-field coupling between the high current regions of the first radiation electrode and the second radiation electrode be equivalently variably adjusted, by making variable the magnitude of the inductance component of the pattern for inductance component addition.

Furthermore, in the method in accordance with the first aspect, it is preferable that the power supply terminal or the ground short-circuit terminal of the first radiation electrode and the ground short-circuit terminal of the second radiation electrode be juxtaposed with a spacing therebetween, that the power supply terminal or the ground short-circuit terminal of the first radiation electrode, and the ground short-circuit terminal of the second radiation electrode be short-circuited, by utilizing the pattern for inductance component addition, and that the quantity of the magnetic-field coupling between the high current regions of the first radiation electrode and the second radiation electrode be equivalently variably adjusted, by making variable the magnitude of the inductance component of the pattern for inductance component addition.

Moreover, in the method in accordance with the first aspect, preferably, the pattern for inductance component addition is made to also perform the function of an electrode pattern which constitutes a matching circuit.

In accordance with a second aspect of the present invention, there is provided a surface-mounted type antenna comprising a dielectric substrate, a first radiation electrode to which power is applied formed on the surface of the dielectric substrate, and a second radiation electrode which is disposed adjacent to the first radiation electrode on the dielectric substrate with a spacing therebetween. In this surface-mounted type antenna, the strong electric-field regions of the first radiation electrode and the second radiation electrode wherein each of the electric fields of these radiation electrodes is the strongest, are disposed adjacent to each other with a spacing therebetween, the high current regions of the first radiation electrode and the second radiation electrode wherein each of the currents of these radiation electrodes is the highest, are disposed adjacent to each other with a spacing therebetween, and the space between the first radiation electrode and the second radiation electrode diverges from the high current region side to the strong electric-field region side.

Furthermore, in this method in accordance with the second aspect, preferably, a power supply terminal or a ground short-circuit terminal is connected to the high current region of the first radiation electrode, a ground short-circuit terminal is connected to the high current region of the second radiation electrode, the power supply terminal or the ground short-circuit terminal of the first radiation electrode and the ground short-circuit terminal of the second radiation electrode are juxtaposed with a spacing therebetween. It is further preferable that a pattern for inductance component addition which short-circuits the power supply terminal or the ground short-circuit terminal of the power supply radiation electrode and the ground short-circuit terminal of the second radiation electrode, be formed, that the magnitude of the inductance component of the pattern for inductance component addition be set to a value such as to allow the return loss characteristics in the dual resonance of the first radiation electrode and the second radiation electrode to be obtained, the return loss characteristics meeting a predetermined antenna characteristic condition, and that the resonance frequency of the first radiation electrode is lower than that of the second radiation electrode, in the frequency band of dual resonance.

The present invention provides, in a third aspect, a communication device equipped with a surface-mounted type antenna produced by adjusting and setting the dual-resonance frequency using a method for adjusting and setting the dual-resonance frequency of a surface-mounted type antenna, in accordance with the first aspect, or a communication device equipped with a surface-mounted type antenna in accordance with the second aspect.

In the present invention having the above-described features, the first radiation electrode and the second radiation electrode are arranged so that the strong electric-field regions of the first radiation electrode and the second radiation electrode are disposed adjacent to each other with a spacing therebetween, and are simultaneously arranged so that the high current regions of the first radiation electrode and the second radiation electrode are disposed adjacent to each other with a spacing therebetween.

Meanwhile, the present inventors discovered, during our research and development carried out on the surface-mounted type antenna, that the quantity of the electric-field coupling between the strong electric-field regions of the first radiation electrode and the second radiation electrode, and the quantity of the magnetic-field coupling between the high current regions of these radiation electrodes must both be in conditions suited for dual resonance, in order to achieve a dual-resonance state of the first radiation electrode and the second radiation electrode, the dual-resonance condition allowing an improvement in the antenna characteristics, such as the widening of the frequency band.

In the present invention, as described above, when disposing the strong electric-field regions of the first radiation electrode and the second radiation electrode so as to be adjacent to each other with a spacing therebetween, simultaneously disposing the high current regions of these radiation electrodes so as to be adjacent to each other with a spacing therebetween, and thereupon adjusting and setting the surface-mounted type antenna, each of the quantity of the electric-field coupling between the strong electric-field regions and the quantity of the magnetic-field coupling between the high current regions is variably adjusted, and both the quantities of the electric-field coupling and the magnetic-field coupling are set to conditions which allow return loss (reflection loss) characteristics in the dual resonance of the first radiation electrode and the second radiation electrode to be achieved, the return loss characteristics meeting a predetermined antenna characteristic condition such as the widening of the frequency band. In other words, the reflection loss in the dual resonance of the first radiation electrode and the second radiation electrode are set to a low value not higher than a predetermined value within the range of the set frequency. This allows a surface-mounted type antenna having required antenna characteristics to be obtained easily and in a short time.

The above and other objects, features, and advantages of the present invention will be clear from the following detailed description of the preferred embodiments of the invention in conjunction with the accompanying drawings.

BRIEF DESCRIPTION OF THE DRAWING(S)

Figure 9:
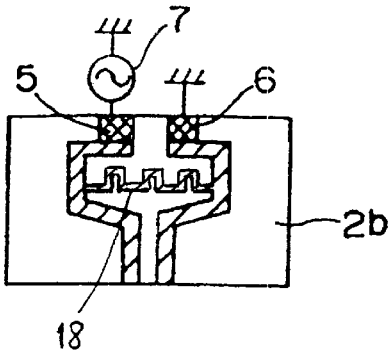
Figure 14:
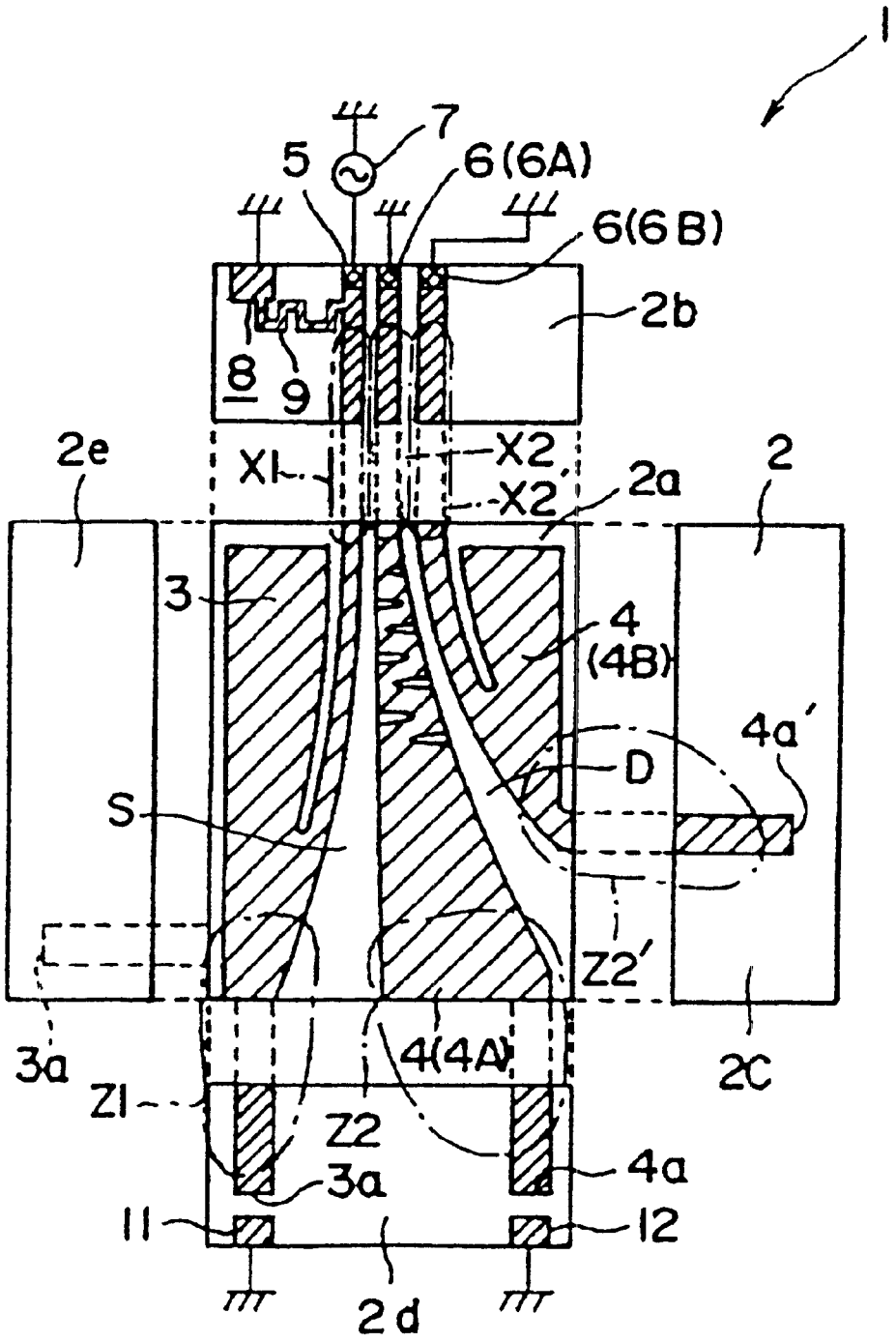
Figure 15:
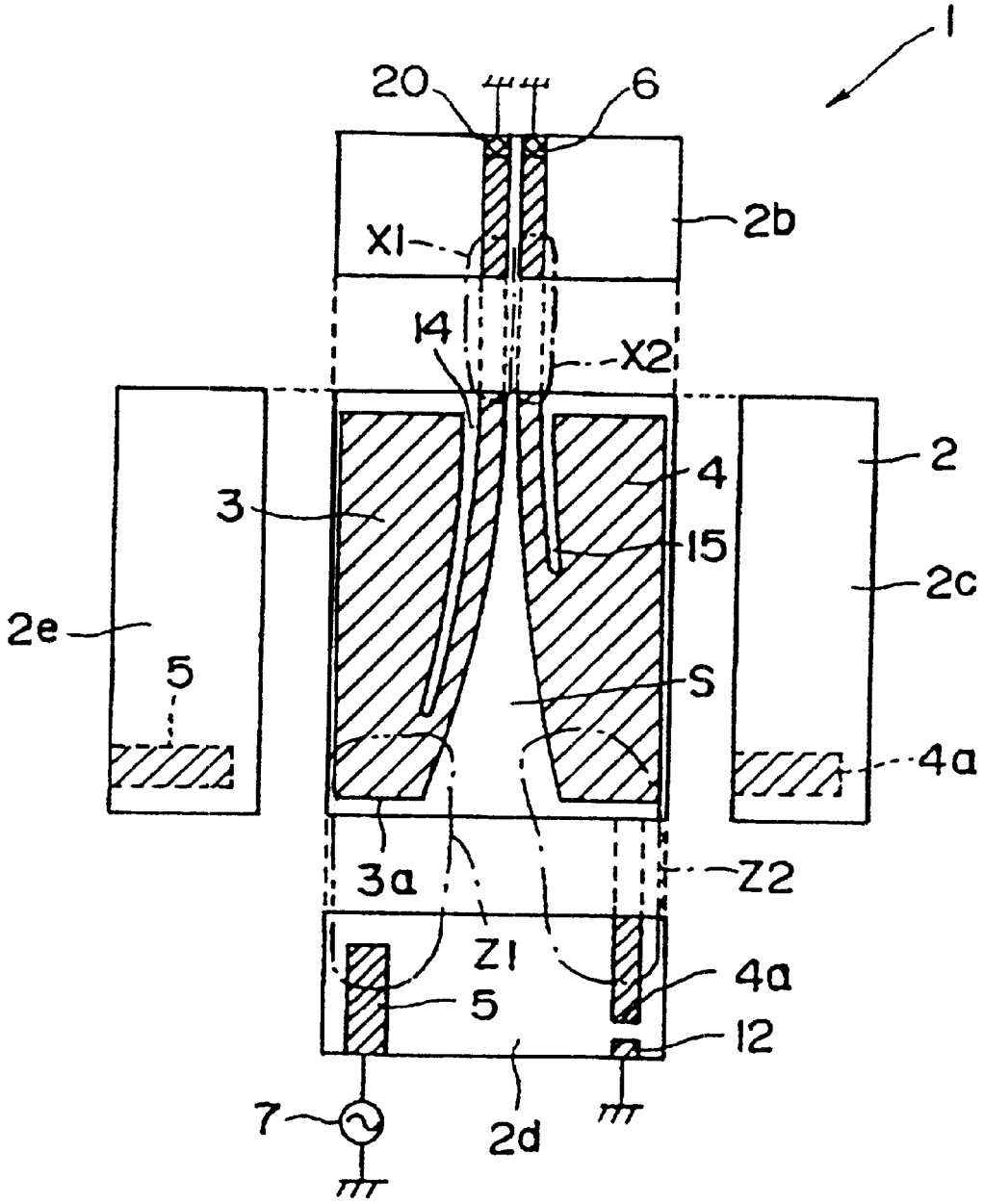
Figure 16:
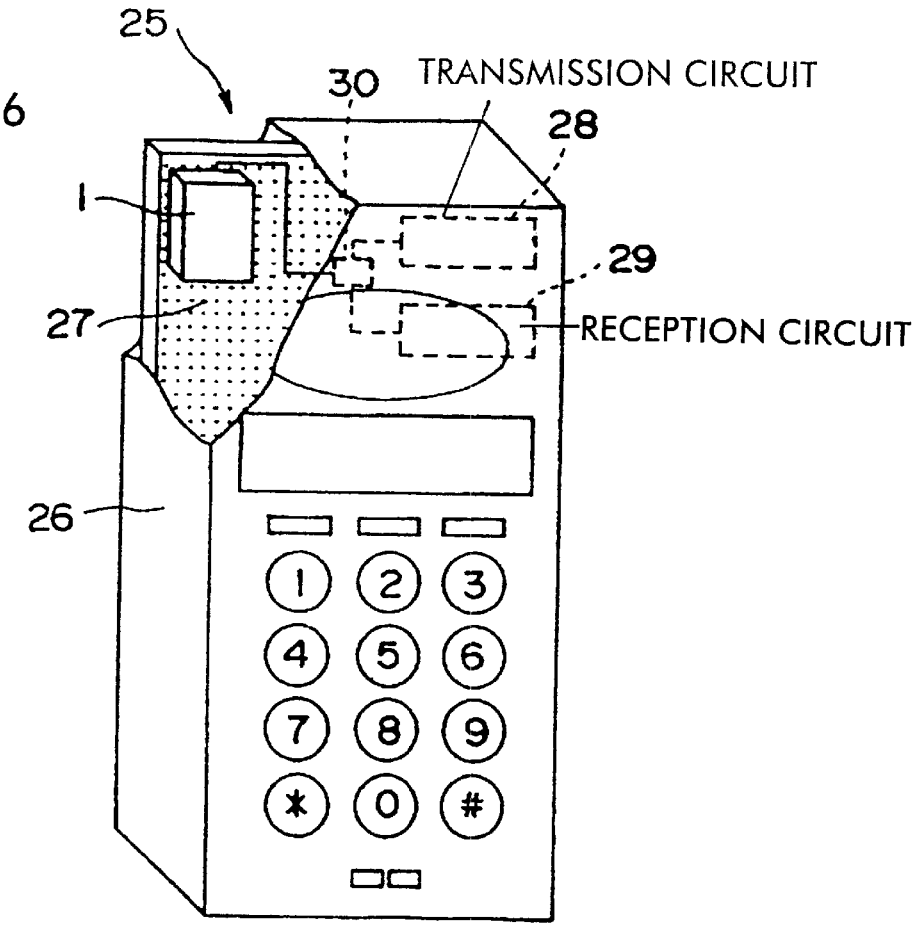
Figure 17:
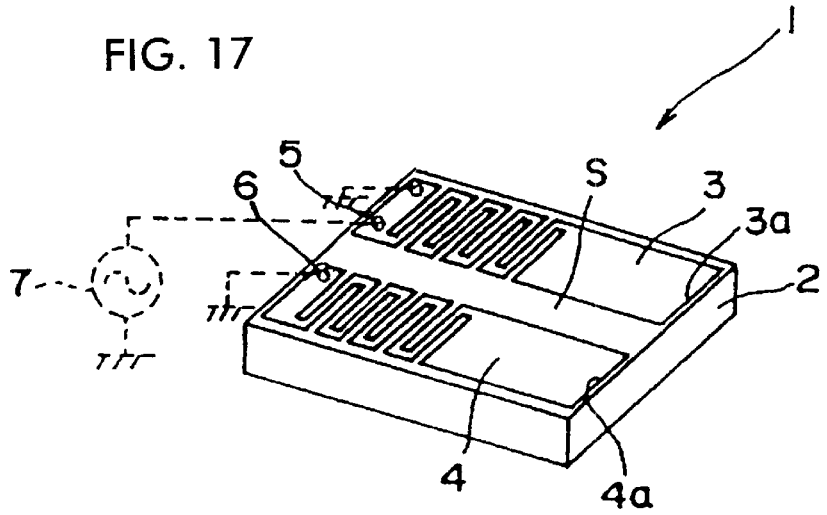

FIGS. 6A through 6D are diagrams showing an example of a variation in the return loss characteristics when the resonance frequency of the second radiation electrode is variably adjusted, in the case where the capacitance between the open end of the first radiation electrode and the ground, and the capacity between the open end of the second radiation electrode and ground are each set to smaller values than the conditions suited for the dual resonance;

FIGS. 7A through 7D are diagrams showing an example of a variation in the return loss characteristics when the resonance frequency of the second radiation electrode is variably adjusted, in the case where the magnitude of the inductance component on the conductive path which has branched off from the first radiation electrode and which is connected to the ground, is set to a condition suited for the dual resonance;

FIGS. 8A through 8D are diagrams showing an example of a variation in the return loss characteristics when the resonance frequency of a second radiation electrode is variably adjusted, in the case where the magnitude of the inductance component on the conductive path which is branched off from the first radiation electrode and which is connected to ground is set to a condition unsuited for the dual resonance;

FIG. 9 is a schematic view illustrating a pattern for inductance component addition between the power supply terminal of the first radiation electrode and the ground short-circuit terminal of the second radiation electrode, the pattern for inductance component addition characterizing a second embodiment of the present invention;

FIGS. 10A through 10D are diagrams showing an example of a variation in the return loss characteristics when the resonance frequency of the second radiation electrode is variably adjusted, in the case where the magnitude of the inductance component of the pattern for inductance component addition between the power supply terminal of the first radiation electrode and the ground short-circuit terminal of the second radiation electrode is set to a condition suited for the dual resonance;

FIGS. 11A through 11D are diagrams showing another example of a variation in the return loss characteristics when the resonance frequency of the second radiation electrode is variably adjusted, in the case where the magnitude of the inductance component of the pattern for inductance component addition between the ground terminal of the power supply terminal of the first radiation electrode and the ground short-circuit terminal of the second radiation electrode is set to a condition suited for the dual resonance;

FIGS. 12A through 12D are diagrams showing another example of a variation in the return loss characteristics when the resonance frequency of a second radiation electrode is variably adjusted, in the case where the magnitude of the inductance component of the pattern for inductance component addition between the ground terminal of the power supply terminal of the first radiation electrode and the ground short-circuit terminal of the second radiation electrode is set to a condition unsuited for the dual resonance;

FIGS. 13A through 13C are explanatory views of a third embodiment of the present invention;

FIG. 14 is an explanatory view of a fourth embodiment of the present invention;

FIG. 15 is an explanatory view of a fifth embodiment of the present invention;

FIG. 16 is a schematic view illustrating an example of a communication device; and FIG. 17 is a schematic view illustrating a conventional example of a surface-mounted type antenna.

DETAILED DESCRIPTION OF EMBODIMENTS OF THE INVENTION

Figure 1:
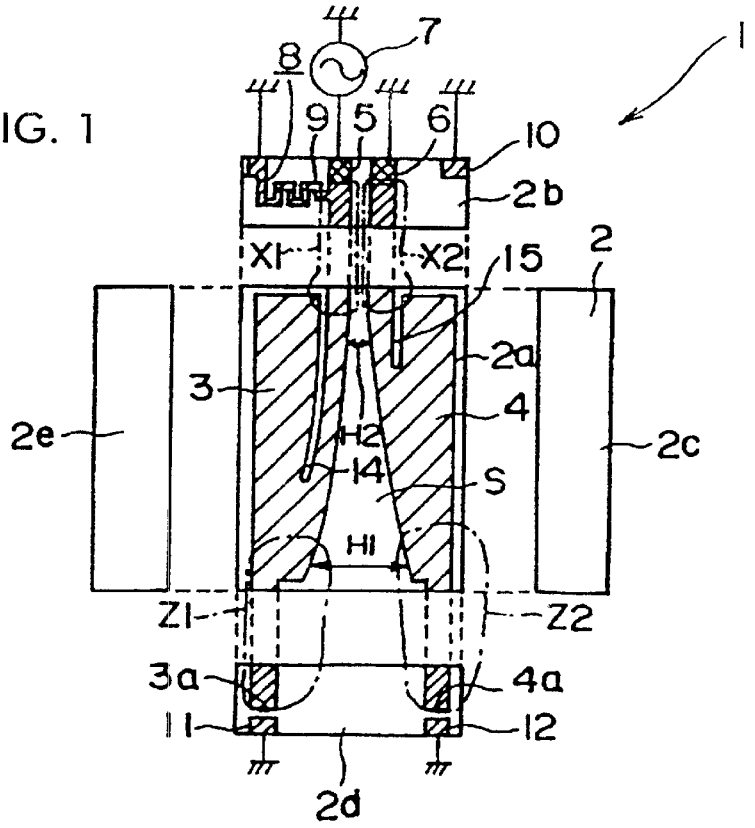
FIG. 1 is a schematic explanatory view of a surface-mounted type antenna in accordance with a first embodiment of the present invention.

FIG. 1 is a schematic development view showing a surface-mounted type antenna in accordance with a first embodiment of the present invention. In the descriptions of this first embodiment, the parts having the same names as those of the conventional example has been given the same reference numerals.

The surface-mounted type antenna 1 shown in FIG. 1 is constructed by forming electrode patterns such as a power supplied first radiation electrode 3 and a power non-supplied (power not directly supplied) second radiation electrode 4 on the surface of a dielectric substrate 2 having a rectangular parallelepiped shape. Herein, the radiation electrode to which power is supplied from a power supply is called the first radiation electrode. The radiation electrode to which power is supplied indirectly, i.e., by electromagnetic coupling is called the second radiation electrode. This first embodiment is characterized in that the strong electric-field region Z1 in which the electric field of the first radiation electrode 3 is the strongest, and the strong electric-field region Z2 in which the electric field of the second radiation electrode 4 is the strongest, are disposed adjacent to each other, and that simultaneously the high current region X1 in which the current of the first radiation electrode 3 is the highest, and the high current region X2 in which the current of the second radiation electrode 4 is the highest, are disposed adjacent to each other. The first embodiment is further characterized in that the first radiation electrode 3 and the second radiation electrode 4 are arranged so as to create a dual resonance, and that the space S between the first radiation electrode 3 and the second radiation electrode 4 diverges from the above-described high current region X1 and X2 sides to the strong electric-field region Z1 and Z2 sides. Moreover, the first embodiment is characterized in that a meander-shaped pattern 9, which is capable of performing the function of an electrode pattern in a matching circuit, is formed on the dielectric substrate 2.

More specifically, in the first embodiment, as shown in FIG. 1, the first radiation electrode 3 and the second radiation electrode 4 are juxtaposed on the top surface 2*a* of the dielectric substrate 2 with a space therebetween. On the side surface 2*b* of the dielectric substrate 2, a power supply terminal 5 and a short-circuit terminal 6, each of which vertically extends in the figure, are disposed adjacent to each other with a spacing therebetween. The power supply terminal 5 is connected to the high current region X1 situated on one end side of the first radiation electrode 3, while the short-circuit terminal 6 is connected to the high current region X2 situated on one end side of the second radiation electrode 4.

Narrow patterns extend from the strong electric-field regions Z1 and Z2 situated on the other end sides of the first radiation electrode 3 and the second radiation electrode 4 to the side surface 2*d*, and the tips thereof constitute open ends 3*a* and 4*a*, respectively. Fixed electrodes 11 and 12, each of which is equivalent to ground, are formed adjacent to the open ends 3*a* and 4*a* of the first radiation electrode 3 and the second radiation electrode 4 on the side surface 2*d*, respectively, with a spacing therebetween. In this first embodiment, the spacing between the open end 3*a* of the first radiation electrode 3 and the fixed electrode 11, and the spacing between the open end 4*a* of the second radiation electrode 4 and the fixed electrode 12 are each arranged so as to be narrow, so that the spacing between the open end 3*a* and the fixed electrode 11 (i.e., between the open end 3*a* and ground), and the spacing between the open end 4*a* and the fixed electrode 12 (i.e., between the open end 4*a* and ground) are each provided with large capacitances.

Also, as shown in FIG. 1, a conductive pattern 8, which is branched off from the power supply terminal 5, and which is connected to ground, is formed on the side surface 2*b* of the dielectric substrate 2, and a meander-shaped pattern 9, which is a pattern for inductance component addition, is interposed in this conductive pattern 8. This meander-shaped pattern 9 has the function of an electrode in a matching circuit. By forming the meander-shaped pattern 9, a current path is constructed which leads from the high current region X1 of the first radiation electrode 3 to the high current region X2 of the second radiation electrode 4 via the meander-shaped pattern 9, the ground, and the ground short-circuit terminal 6 of the second radiation electrode 4.

Such a surface-mounted type antenna 1 is mounted on a circuit board of a communication device such as a portable telephone in such a manner wherein the bottom surface of the dielectric substrate 2 is used as a mounting surface, and a signal supply source 7 formed on the circuit board and the above-described power supply terminal 5 are conductively connected. When a signal is supplied from the signal supply source 7 to the power supply terminal 5, the signal is directly supplied to the first radiation electrode 3, and is simultaneously supplied to the non-supplied radiation electrode 4 by virtue of an electromagnetic coupling. With the signal supplied, the first radiation electrode 3 and the second radiation electrode 4 each resonate, thereby performing antenna operations.

Figure 2:
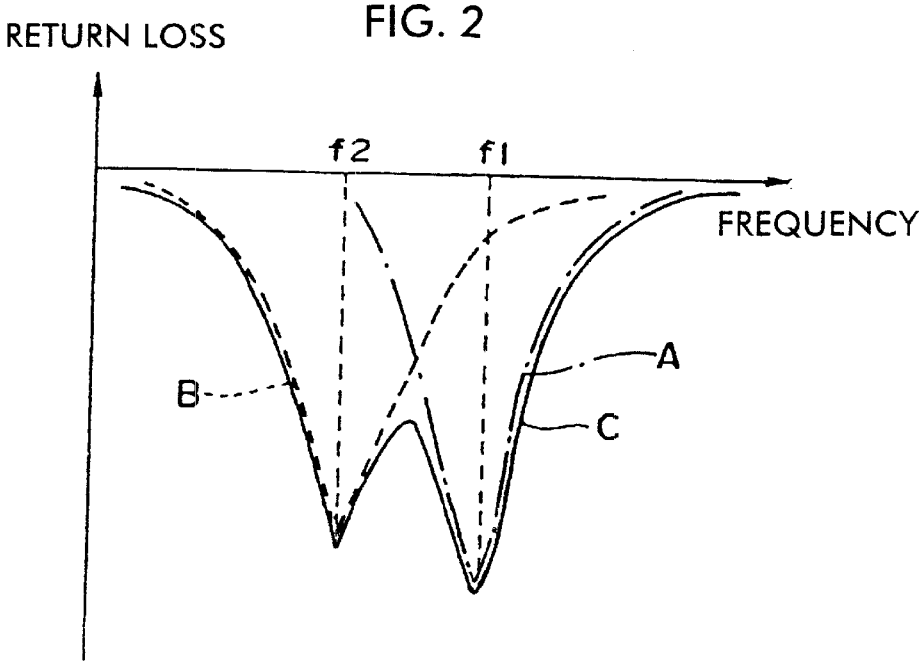
FIG. 2 is a diagram showing an example of return loss characteristics in a superior dual-resonance state.

FIG. 2 shows an example of the return loss (reflection loss) characteristics in the superior dual resonance by the first radiation electrode 3 and the second radiation electrode 4. In FIG. 2, the chain line A designates the return loss characteristics of the first radiation electrode 3, the dotted line B designates the return loss characteristics of the second radiation electrode 4, and the solid line C designates the resultant return loss characteristics of the return loss characteristics by the first radiation electrode 3 and that by the second radiation electrode 4, that is, the return loss characteristics of the surface-mounted type antenna 1.

A "superior dual resonance" as shown in FIG. 2 relates to a state wherein the resonance frequency f1 of the first radiation electrode 3 and the resonance frequency f2 of the second radiation electrode 4 are conducting a dual resonance (overlapping each other) without attenuation, even though the resonance frequencies f1 and f2 of the first radiation electrode 3 and the second radiation electrode 4 are positioned close to each other. This state can meet a required antenna characteristic condition such as the widening of the frequency band.

The present inventors noted, during our various experiments conducted on the surface-mounted type antenna, that, in order to achieve superior return loss characteristics in a dual resonance as shown in FIG. 2, the quantity of the electric-field coupling between the strong electric-field regions Z1 and Z2 of the first radiation electrode 3 and the second radiation electrode 4, and the quantity of the magnetic-field coupling between the high current regions X1 and X2 of these radiation electrodes must both be conditions suited for the dual resonance.

Accordingly, in the surface-mounted type antenna 1 shown in the first embodiment, the quantity of the electric-field coupling between the strong electric-field regions Z1 and Z2 of the first radiation electrode 3 and the second radiation electrode 4, and the quantity of the magnetic-field coupling between the high current regions X1 and X2 of these radiation electrodes are variably adjusted independently of each other, as described later, and both the quantities of the electric-field coupling and the magnetic-field coupling are set to conditions suited for the dual resonance. This allows the surface-mounted type antenna 1 shown in the first embodiment to achieve a superior dual-resonance state, and to realize the widening of the frequency band.

Hereinafter, an example of a method for adjusting and setting the dual-resonance frequency of the surface-mounted type antenna 1 having the above-described features will be described.

In order to variably adjust the quantity of the electric-field coupling between the strong electric-field regions Z1 and Z2 of the first radiation electrode 3 and the second radiation electrode 4, the following two steps are used in the first embodiment. A first step is a step whereby the quantity of the electric-field coupling between the strong electric-field regions Z1 and Z2 of the first radiation electrode 3 and the second radiation electrode 4 is variably adjusted, by variably adjusting the spacing H1 between the strong electric-field regions Z1 and Z2.

A second step is a step whereby the quantity of the electric-field coupling between the strong electric-field regions Z1 and Z2 is relatively variably adjusted, by varying the spacings between the open ends 3*a* and 4*a* of the first radiation electrode 3 and the second radiation electrode 4 and the grounds to variably adjust the capacitances between the above-mentioned open ends 3*a* and 4*a* and the grounds.

Next, in order to variably adjust the quantity of the magnetic-field coupling between the high current regions X1 and X2 of the first radiation electrode 3 and the second radiation electrode 4, the following two steps are used in the first embodiment. A first step is a step whereby the quantity of the magnetic-field coupling between the high current regions X1 and X2 of the first radiation electrode 3 and the second radiation electrode 4 is variably adjusted, by variably adjusting the spacing H2 between the high current regions X1 and X2 of these radiation electrodes.

The second step is a step whereby the quantity of the magnetic-field coupling between the high current regions X1 and X2 is equivalently variably adjusted, by varying the pitch of the meander lines of the above-described meander-shaped pattern 9, the number of the meanders, the narrowness of the meander lines, etc. to variably adjust the magnitude of the inductance component L1 of the meander-shaped pattern 9, and thereby variably adjusting the amount of current flowing through the above-mentioned current path which leads from the high current region X1 of the first radiation electrode 3 to the high current region X2 of the second radiation electrode 4 via the meander-shaped pattern 9 and the ground.

In the first embodiment, the quantity of the electric-field coupling between the strong electric-field regions Z1 and Z2 of the first radiation electrode 3 and the second radiation electrode 4 is variably adjusted, by variably adjusting the spacing H1 between the strong electric-field regions Z1 and Z2 of these radiation electrodes, and the capacitances between the open ends 3*a* and 4*a* and the grounds, as well as the quantity of the magnetic-field coupling between the high current regions X1 and X2 of these radiation electrodes is variably adjusted, by variably adjusting the spacing H2 between the high current regions X1 and X2, and the magnitude of the inductance component L1 of the meander-shaped pattern 9, as described above. Thereby, each of the quantities of the electric field coupling and the magnetic-field coupling is set to a condition such as to allow the return loss characteristics in a dual resonance to be achieved, the return loss characteristics meeting a predetermined antenna characteristic condition such as the widening of the frequency band. In other words, the reflection loss in the dual resonance of the first radiation electrode 3 and the second radiation electrode 4 is set to a value not higher than a predetermined value within the range of the set frequency. The adjustment and setting of the quantities of the electric field coupling and magnetic-field coupling are performed based on experiments, calculations, etc.

The variable adjustment of the quantity of the electric-field coupling between the strong electric-field regions Z1 and Z2 by the variable adjustment of the spacing H1 between the strong electric-field regions Z1 and Z2, and of the capacitances between the open ends 3*a* and 4*a* and the grounds, and the variable adjustment of the quantity of the magnetic-field coupling between the high current regions X1 and X2 by the variable adjustment of the spacing H2 between the high current regions X1 and X2, and of the magnitude of the inductance component L1 of the meander-shaped pattern 9, as shown in the first embodiment, can be performed independently of each other without mutually affecting each other. This allows the adjustment and setting of each of the quantities of the electric-field coupling and the magnetic-field coupling for achieving a condition suited for the dual resonance to be easily executed.

After the adjustment and setting of the quantities of the electric-field coupling and the magnetic-field coupling have thus been completed, the magnitude of the inductance components of the first radiation electrode 3 and the second radiation electrode 4 are varied, by adjusting the depth or the width of slits 14 and 15, for example, as shown in FIG. 1, which are patterns for frequency adjustment for use in the first radiation electrode 3 and the second radiation electrode 4, and thereby the resonance frequencies f1 and f2 of the first radiation electrode 3 and the second radiation electrode 4 are adjusted and set to set frequencies. Alternatively, the adjustment and setting of these resonance frequencies f1 and f2 may be performed as preprocessing of the adjustment and setting of the quantities of the electric-field coupling and the magnetic-field coupling. Here, the above-mentioned patterns 14 and 15 for frequency adjustment are formed at areas so as not to affect the electric-field coupling and the magnetic-field coupling in the first radiation electrode 3 and the second radiation electrode 4, respectively.

In accordance with the first embodiment, by disposing the strong electric-field regions Z1 and Z2 of the first radiation electrode 3 and the second radiation electrode 4 so as to be adjacent to each other, and simultaneously by disposing the high current regions X1 and X2 of these radiation electrodes so as to be adjacent to each other, the quantity of the electric-field coupling between the strong electric-field regions Z1 and Z2 of the first radiation electrode 3 and the second radiation electrode 4, and the quantity of the magnetic-field coupling between the high current regions X1 and X2 of these radiation electrodes can be variably adjusted (controlled) independently of each other. Hence, for example, when designing the surface-mounted type antenna 1, both the quantities of the electric-field coupling and the magnetic-field coupling can be set to conditions suited for the dual resonance by variably adjusting each of the quantities of the electric-field coupling and the magnetic-field coupling. As a result, a superior dual-resonance state by the first radiation electrode 3 and the second radiation electrode 4 can be easily ensured. This allows the widening of the frequency band to be easily realized.

Furthermore, in the first embodiment, as described above, since the quantity of the electric-field coupling and the quantity of the magnetic-field coupling can be variably adjusted independently of each other, the adjustment and setting of the quantities of the electric-field coupling and the magnetic-field coupling can be performed easily and in a short time. This allows labor and time required to design the surface-mounted type antenna 1 to be decreased, which results in a reduced design cost, and consequently a reduced production cost of the surface-mounted type antenna 1.

Moreover, in the first embodiment, as described above, since the spacing H1 between the strong electric-field regions Z1 and Z2 and the spacing H2 between the high current regions X1 and X2 are variably adjusted independently of each other, without maintaining the uniform width of the space S between the first radiation electrode 3 and the second radiation electrode 4, both the quantities of the electric-field coupling and the magnetic-field coupling can be easily set to conditions suited for the dual resonance. By thus setting the spacings H1 and H2 in order to obtain the quantities of the electric-field coupling and the magnetic-field coupling which are suited to the dual resonance, the space S between the first radiation electrode 3 and the second radiation electrode 4 diverges from the high current region X1 and X2 sides to the strong electric-field region Z1 and Z2 sides, as shown in this embodiment.

More specifically, since the spacing H1 for obtaining the electric-field coupling between the strong electric-field regions Z1 and Z2 suited for the dual resonance is wider than the spacing H2 for obtaining the magnetic-field coupling between the high current regions X1 and X2 suited for the dual resonance, by setting each of the spacings H1 and H2 to a condition suited for the dual resonance, the space S between the first radiation electrode 3 and the second radiation electrode 4 diverges from the high current region X1 and X2 sides to the strong electric-field region Z1 and Z2 sides, as described above, as a natural consequence.

Conventionally, the space between the first radiation electrode 3 and the second radiation electrode 4 has been uniform, and hence, when such a uniform-width space S has been set to a wide spacing H1 used for the quantity of electric-field coupling suited for the dual resonance, the quantity of magnetic-field coupling has become smaller, due to the spacing H1, than the condition suited for the dual resonance, although the quantity of electric-field coupling is in a condition suited for the dual resonance. This has made it difficult to obtain a satisfactory dual-resonance condition. Conversely, when the uniform-width space S has been set to a narrow spacing H2 used for the quantity of magnetic-field coupling suited for the dual resonance, the quantity of electric-field coupling has become larger, due to the spacing H2, than the condition suited for the dual resonance, although the quantity of magnetic-field coupling is in a condition suited for the dual resonance. In this case also, it has been very difficult to obtain a satisfactory dual-resonance condition.

In contrast, in this first embodiment, the spacing H1 between the strong electric-field regions Z1 and Z2 and the spacing H2 between the high current regions X1 and X2 are variably adjusted independently of each other so that the space S between the power supplied radiation electrode 3 and the power non-supplied radiation electrode 4 diverges from the high current regions X1 and X2 sides to the strong electric-field region Z1 and Z2 sides. Hence, it is possible to set both the spacing H1 between the strong electric-field regions Z1 and Z2 and the spacing H2 between the high current regions X1 and X2 to conditions which allow the quantities of the electric-field coupling and the magnetic-field coupling which are suited for the dual resonance to be achieved, which leads to a superior dual-resonance state.

The foregoing has been confirmed in the following experiments by the present inventors. The experiments were such that the following three kinds of surface-mounted type antennas 1 were formed in which the configurations of the spaces S between their respective first radiation electrodes 3 and second radiation electrodes 4 differed from one another, and that variations in the return loss characteristics when the resonance frequency f2 of the second radiation electrode 4 were varied toward the high frequency side by varying the magnitude of the inductance component of the second radiation electrode 4 alone, were investigated with regard to each of these three surface-mounted type antennas 1.

The three kinds of surface-mounted type antennas 1 employed in these experiments are as follows. As shown in the first embodiment, a first surface-mounted type antenna 1 has a form in which the space S between the first radiation electrode 3 and the second radiation electrode 4 diverges from the high current region X1 and X2 sides to the strong electric-field region Z1 and Z2 sides. The spacing H1 between the strong electric-field regions Z1 and Z2 is set to a spacing which allows the quantity of the electric-field coupling suited for the dual resonance to be obtained, while the spacing H2 between the high current regions X1 and X2 is set to a spacing which allows the quantity of the magnetic-field coupling suited for the dual resonance to be obtained.

A second surface-mounted type antenna 1 has an uniform-width space S between the first radiation electrode 3 and the second radiation electrode 4, as in the case of the above-described conventional example, and the uniform-width space S thereof is set to a narrow spacing used for the magnetic-field coupling suited for the dual resonance. A third surface-mounted type antenna 1 has also a uniform-width space S between the first radiation electrode 3 and the second radiation electrode 4, as in the case of the above-described second surface-mounted type antenna, and the uniform-width space S thereof is set to a wide spacing used for the electric-field coupling suited for the dual resonance.

The experimental results for the first, second, and third surface-mounted type antennas 1 are shown in FIGS. 3A through 3D, 4A through 4D, and 5A through 5D, respectively.

Figure 3A:
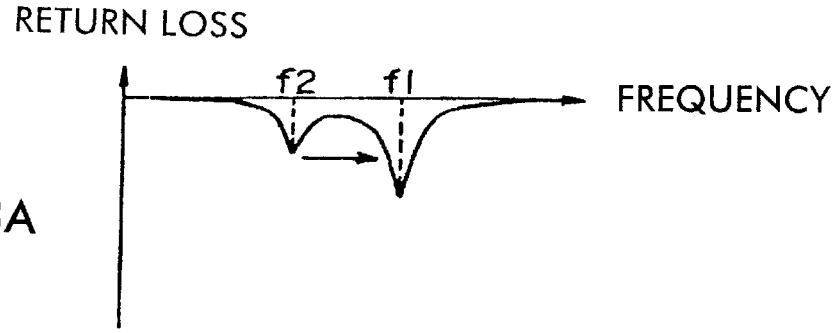
FIGS. 3A through 3D are diagrams showing an example of variations in the return loss characteristics when the resonance frequency of a the second (pow not directly supplied) radiation electrode is variably adjusted, in the case where the space between a first (power supplied) radiation electrode and the second radiation electrode is set to a condition suited for the dual resonance.
Figure 3B:
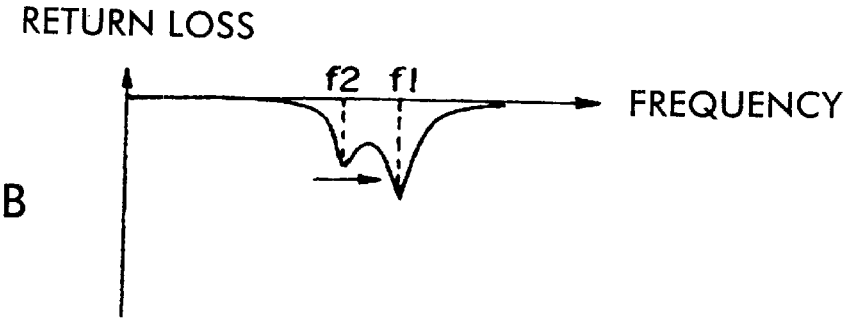
Figure 3C:
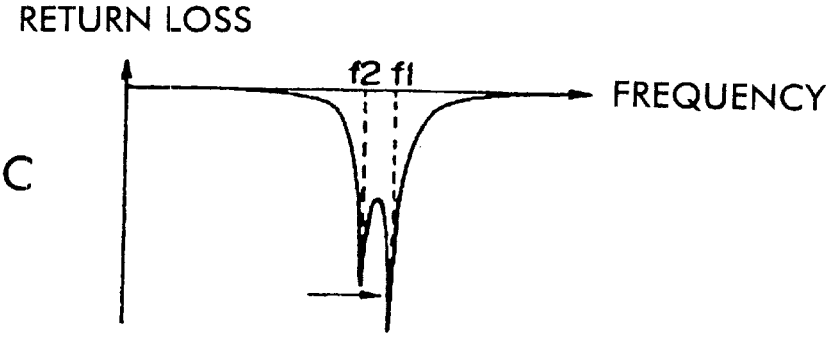
Figure 3D:
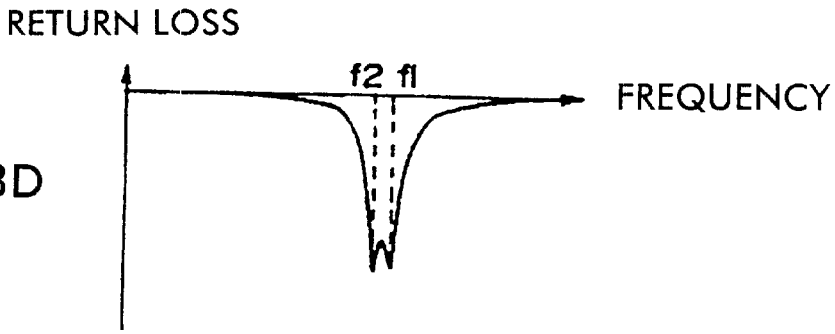
Figure 4A:
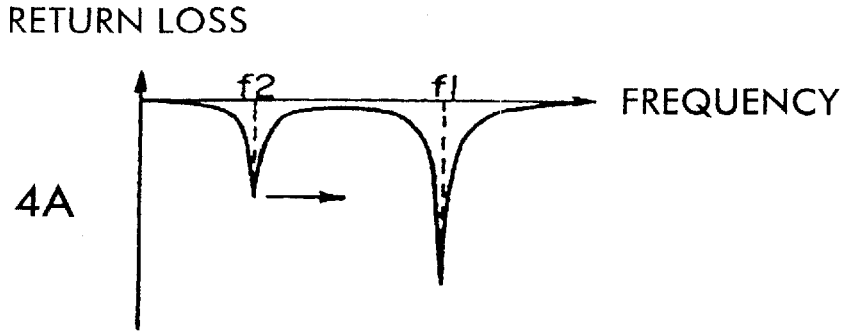
FIGS. 4A through 4D are diagrams showing an example of a variation in the return loss characteristics when the resonance frequency of the second radiation electrode is variably adjusted, in the case where the space between the first radiation electrode and the second radiation electrode is set to a condition unsuited for the dual resonance.
Figure 4B:
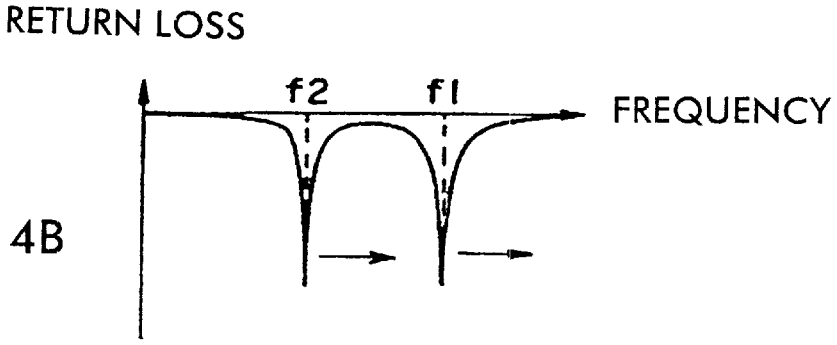
Figure 4C:
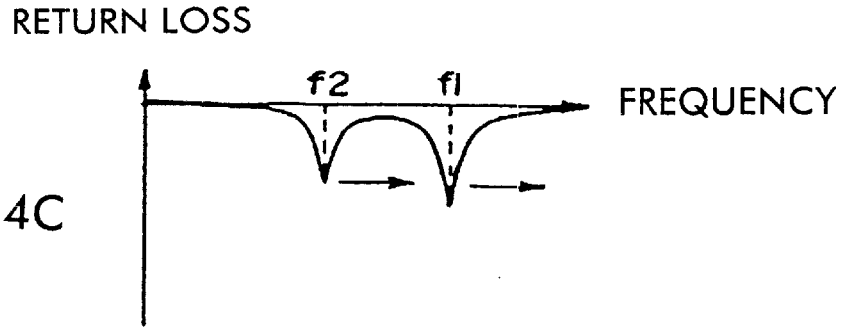
Figure 4D:
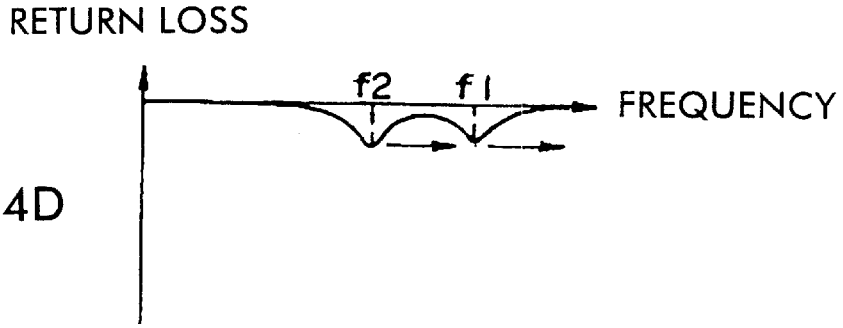
Figure 5A:
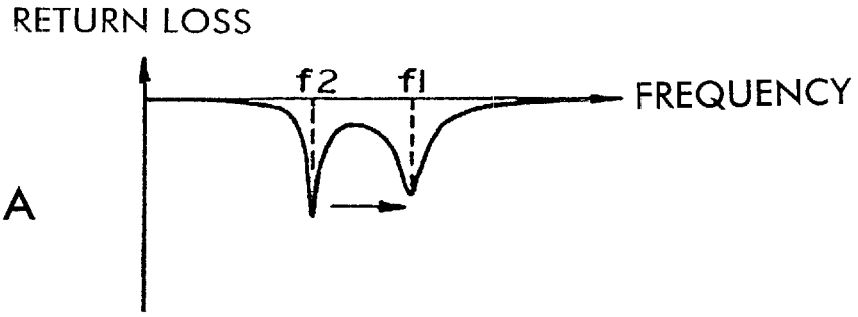
FIGS. 5A through 5D are diagrams showing another example of the variation in the return loss characteristics when the resonance frequency of a second radiation electrode is variably adjusted, in the case where the space between the first radiation electrode and the second radiation electrode is set to a condition suited for the dual resonance.
Figure 5B:
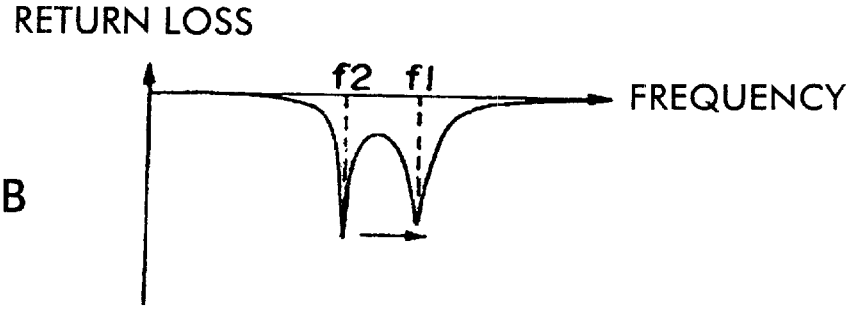
Figure 5C:
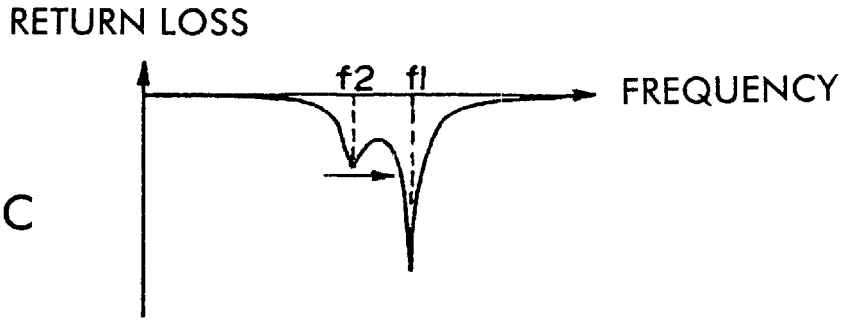
Figure 5D:
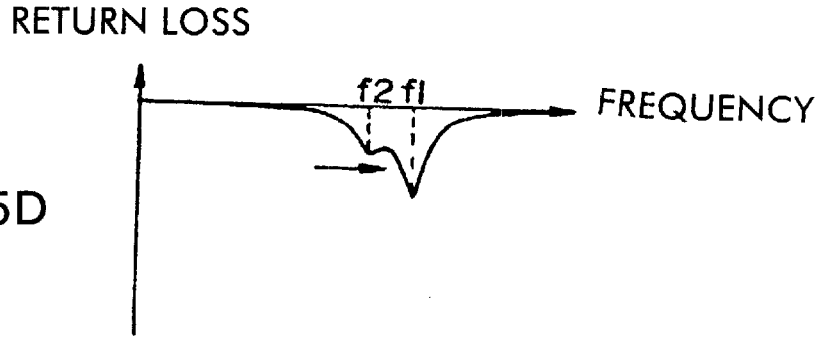
Figure 6A:
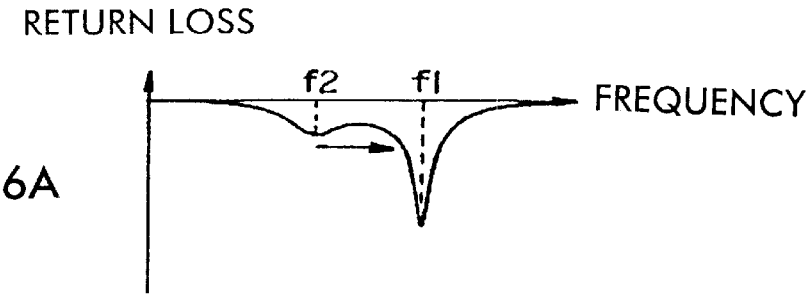
Figure 6B:
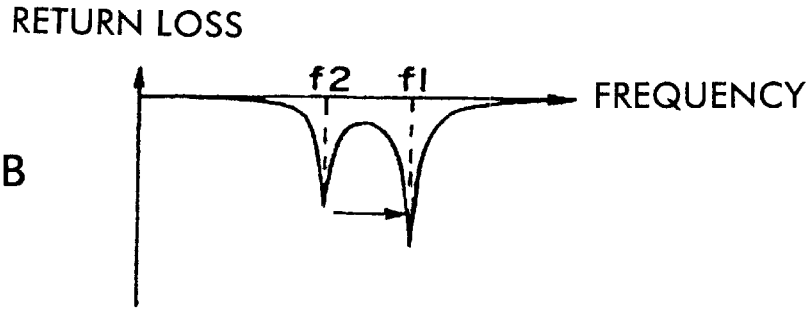
Figure 6C:
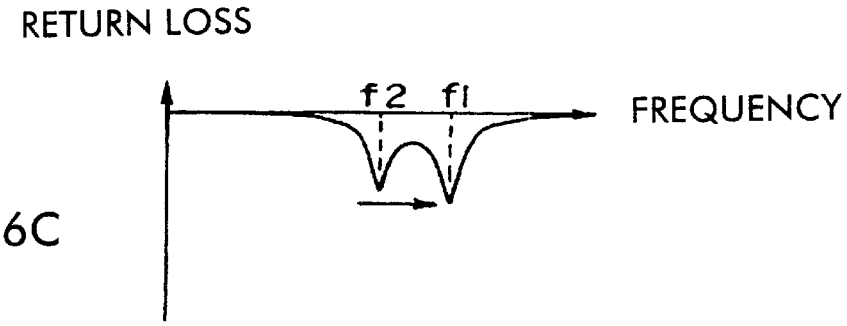
Figure 6D:
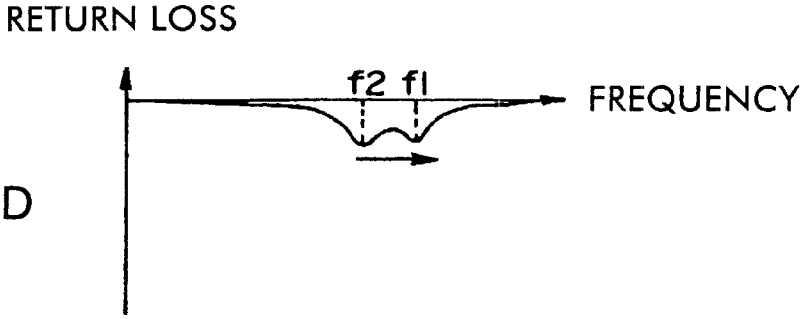

As shown in the first embodiment, in the state wherein the spacing H1 between the strong electric-field regions Z1 and Z2 of the first radiation electrode 3 and the second radiation electrode 4, and the spacing H2 between the high current regions X1 and X2 of these radiation electrodes, are each set to spacings which allow the quantities of the electric-field coupling and the magnetic-field coupling which are suited for the dual resonance to be obtained, as the resonance frequency f2 of the second radiation electrode 4 approaches the resonance frequency f1 of the first radiation electrode 3, as shown in FIGS. 3A through 3D, the return loss with respect to each of the resonance frequency f1 and f2 increases, and the resonance waves of the first radiation electrode 3 and the second radiation electrode 4 create a dual resonance without attenuation, as shown in FIGS. 3C and 3D, thereby providing superior return loss characteristics.

In contrast, in the state wherein the space between the first radiation electrode 3 and the second radiation electrode 4 has a uniform width, and wherein the quantity of magnetic-field coupling is in a condition suited for the dual resonance due to this uniform-width space S, but wherein the quantity of electric-field coupling is in a condition unsuited for the dual resonance, when the resonance frequency f2 of the second radiation electrode 4 is varied toward the high frequency side and is brought close to the resonance frequency f1 of the first radiation electrode 3, the resonance frequency f1 of the first radiation electrode 3 also shifts to the high frequency side, as shown in FIGS. 4A through 4D. In addition, the resonance frequencies of the first radiation electrode 3 and the second radiation electrode 4 attenuate, and provide no satisfactory return loss characteristics in a dual resonance.

On the other hand, in the state wherein the quantity of electric-field coupling is in a condition suited for the dual resonance, but wherein the quantity of magnetic-field coupling is in a condition unsuited for the dual resonance due to the uniform-width space S, when the resonance frequency f2 of the second radiation electrode 4 is varied toward the high frequency side and is brought close to the resonance frequency f1 of the first radiation electrode 3, not only the resonance wave of the second radiation electrode 4 but also that of the first radiation electrode 3 attenuates, as shown in FIGS. 5A through 5D, and provide no satisfactory return loss characteristics in a dual resonance.

As is evident from the above-described experimental results, when the space S between the first radiation electrode 3 and the second radiation electrode 4 is formed into a uniform width space, it is very difficult to set both the quantity of the electric-field coupling between the strong electric-field regions Z1 and Z2 of the first radiation electrode 3 and the second radiation electrode 4, and the quantity of the magnetic-field coupling between the high current regions X1 and X2 of these radiation electrodes to conditions suited for the dual resonance, and hence a satisfactory dual-resonance state is difficult to obtain.

In contrast, as shown in the first embodiment, by arranging the space S between the first radiation electrode 3 and the second radiation electrode 4 so as to diverge from the high current region X1 and X2 sides to the strong electric-field region Z1 and Z2 sides, and by setting the spacing H1 between the strong electric-field regions Z1 and Z2, and the spacing H2 between the high current regions X1 and X2 to conditions which allow the respective quantities of the electric-field coupling and the magnetic-field coupling which are suited for the dual resonance to be achieved, a superior dual-resonance condition can be attained, which leads to the widening of the frequency band.

Meanwhile, the present inventors obtained the following experimental results as shown in FIGS. 6A through 6D, during our various experiments carried out on the surface-mounted type antenna 1. Although each of the spacing H1 between the strong electric-field regions Z1 and Z2, and the spacing H2 between the high current regions X1 and X2 were set to a spacing suited for the dual resonance, the capacitance between the above-described open end 3*a* and ground and the capacitance between the open end 4*a* and ground were each smaller than the condition suited for dual resonance. Consequently, a large quantity of electric field leaked from the strong electric-field regions Z1 and Z2, and excessively increased the quantity of the electric-field coupling between the strong electric-field regions Z1 and Z2, thereby inhibiting a dual resonance. As a result, as shown in FIGS. 6A through 6D, as the resonance frequency f2 of the second radiation electrode 4 was varied toward the high frequency side and was brought close to the resonance frequency f1 of the first radiation electrode 3, the resonance frequency f1 of the first radiation electrode 3 also shifted to the high frequency side, and both the resonance waves of the second radiation electrode 4 and the first radiation electrode 3 attenuated, with the result that satisfactory return loss characteristics in a dual resonance could not be obtained.

In consideration of this, in the first embodiment, as described above, not only by variably adjusting the spacing H1 between the strong electric-field regions Z1 and Z2 of the first radiation electrode 3 and the second radiation electrode 4, but also by variably adjusting the capacitance between the open end 3*a* of the first radiation electrode 3 and the ground, and the capacitance between the open end 4*a* of the second radiation electrode 4 and the ground, the quantity of electric-field coupling is set to a condition which allows an electric-field coupling suited for the dual resonance to be achieved, so that a superior dual-resonance state can be obtained more reliably and easily.

Moreover, the first embodiment is arranged so that, not only by variably adjusting the spacing H2 between the high current regions X1 and X2 of the first radiation electrode 3 and the second radiation electrode 4, but also by variably adjusting the magnitude of the inductance component L1 of the meander-shaped pattern 9, the quantity of magnetic-field coupling between the high current regions X1 and X2 is set to a condition suited for the dual resonance, so that the quantity of magnetic-field coupling can be set to a condition suited for the dual resonance more reliably and easily.

FIGS. 7A through 7D illustrate an example of the variation in the return loss characteristics obtained from the experiments by the present inventors, when the resonance frequency f2 of the second radiation electrode 4 is varied toward the high frequency side by varying the magnitude of the inductance component of the second radiation electrode 4 alone, in the state wherein the magnitude of the inductance component L1 of the meander-shaped pattern 9 is set to a condition suited for the dual resonance.

Figure 7A:
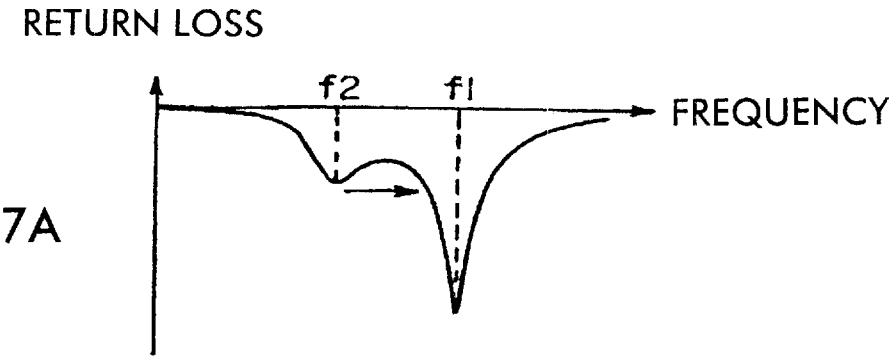
Figure 7B:
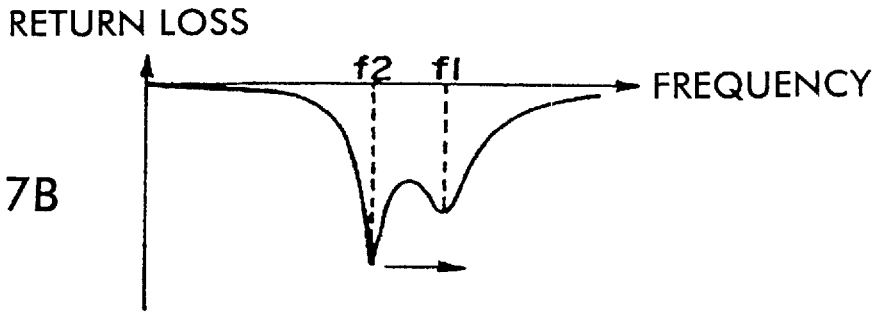
Figure 7C:
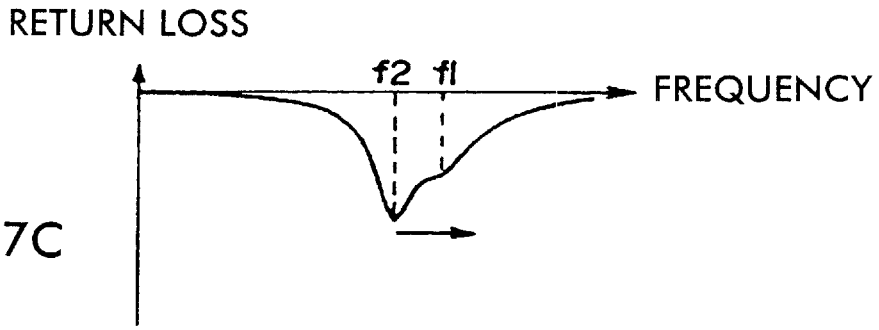
Figure 7D:
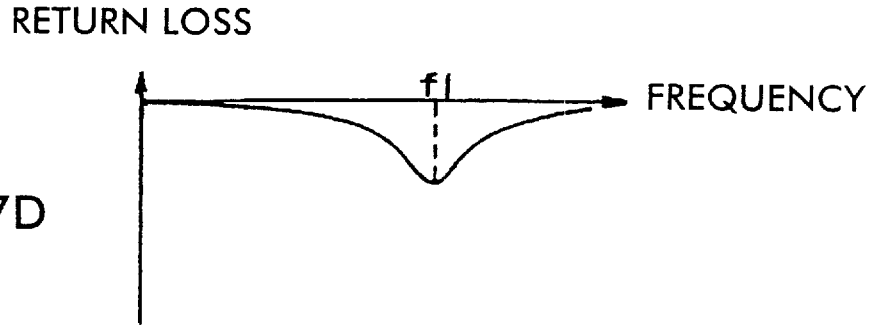
Figure 8A:
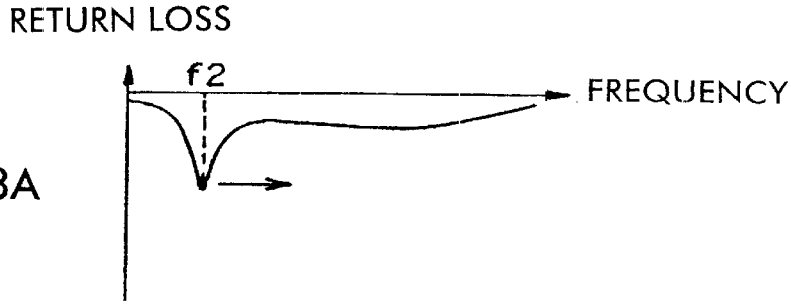
Figure 8B:
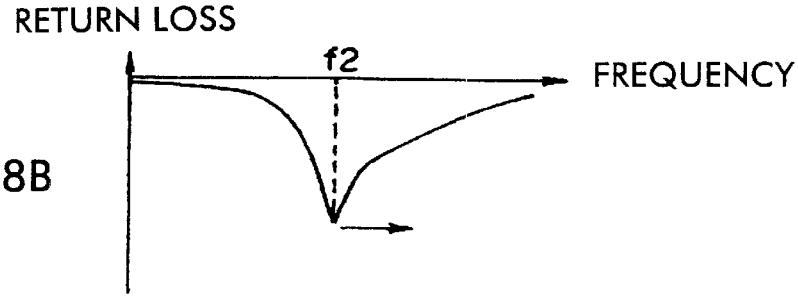
Figure 8C:
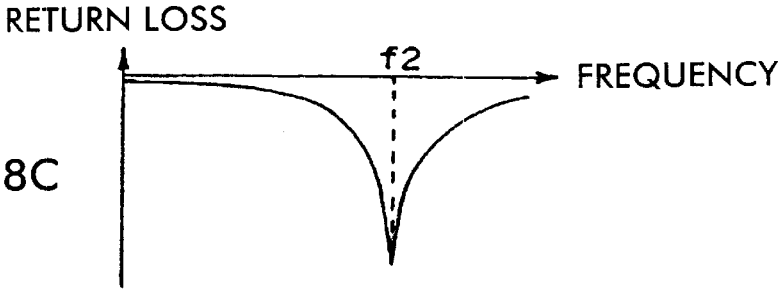
Figure 8D:
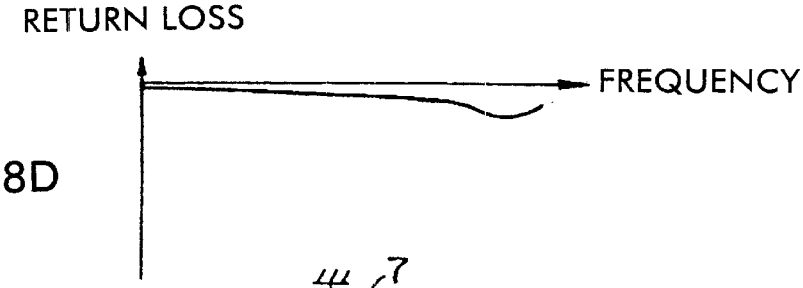

As illustrated in the above-described experimental results of the present inventors, when the magnitude of the inductance component L1 of the meander-shaped pattern 9 is set to a condition suited for the dual resonance, and the quantity of the magnetic-field coupling between the high current regions X1 and X2 is a quantity suited for the dual resonance, superior return characteristics in a dual resonance as shown in FIG. 7B can be obtained.

In contrast, in the state wherein the quantity of magnetic-field coupling between the high current regions X1 and X2 is in a condition unsuited for the dual resonance because the magnitude of the inductance component L1 of the meander-shaped pattern 9 is larger than the condition suited for the dual resonance, the resonance wave of the first radiation electrode 3 attenuates to a very small magnitude such as not to be discriminated, and provides no dual resonance, as seen from the experimental results shown in, for example, FIGS. 8A through 8D.

In the first embodiment, as described above, by variably adjusting not only the spacing H2 between the high current regions X1 and X2, but also the magnitude of the inductance component L1 of the meander-shaped pattern 9, the quantity of magnetic-field coupling between the high current regions X1 and X2 is variably adjusted, so that the quantity of the magnetic-field coupling can be set to a condition suited for the dual resonance more reliably and easily, which leads to superior return loss characteristics.

In the first embodiment, as described above, by variably adjusting not only the spacing H1 between the strong electric-field regions Z1 and Z2, but also the capacitances between the open ends 3*a* and 4*a* of the first radiation electrode 3 and the second radiation electrode 4 and the grounds, the quantity of electric-field coupling between the strong electric-field regions Z1 and Z2 is set to a condition suited for the dual resonance, and simultaneously by variably adjusting not only the spacing H2 between the high current regions X1 and X2, but also the magnitude of the inductance component L1 of the meander-shaped pattern 9, the quantity of magnetic-field coupling between the high current regions X1 and X2 is set to a condition suited for the dual resonance. Hence, a very superior dual-resonance state of the first radiation electrode 3 and the second radiation electrode 4 can be obtained easily and in a short time, while suppressing the upsizing of the surface-mounted type antenna 1. In addition, the degree of flexibility in the design can be improved.

Furthermore, in the first embodiment, since a superior dual-resonance state can be achieved as described above, it is possible to widen the frequency band, and to improve the antenna characteristics. In addition, by providing the construction shown in the first embodiment, the above-described superior dual-resonance state can be stably achieved, so that the reliability of the antenna characteristics can be increased.

Moreover, in the first embodiment, the above-described meander-shaped pattern 9 not only performs a variable adjustment of the quantity of magnetic-field coupling between the high current regions X1 and X2, but also can perform the function of a matching circuit, so that the meander-shaped pattern 9 can achieve a matching while controlling the quantity of magnetic-field coupling. Also, since it is unnecessary to provide a matching circuit outside the surface-mounted type antenna 1, that is, since a communication device is not required to have a matching circuit, it is possible to achieve a surface-mounted type antenna 1 which allows a reduction in the number of components of the communication device and consequently a reduction in the production cost thereof. In addition, as described above, since the meander-shaped pattern 9, which is an electrode pattern of the matching circuit, is formed on the surface of the dielectric substrate 2, a high power can be provided for the surface-mounted type antenna 1.

In the above-described first embodiment, the method for adjusting and setting the frequency of the surface-mounted type antenna 1 at the design stage has been described. Of course, however, when the quantity of electric-field coupling or the quantity of magnetic-field coupling of the first radiation electrode 3 and the second radiation electrode 4 come into a condition unsuited for the dual resonance because of the problem such as working accuracy, and thereby a satisfactory dual resonance cannot be obtained, a variable adjustment of the quantities of the electric-field coupling and the magnetic-field coupling may be executed to perform an adjustment for obtaining a superior dual resonance, by widening the spacing H1 between the strong electric-field regions Z1 and Z2 or H2 between the high current regions X1 and X2 by means of trimming or the like, by varying the magnitude of the inductance component of the meander-shaped pattern 9, or by varying the capacitances between the open ends 3*a* and 4*a* of the first radiation electrode 3 and the second radiation electrode 4 and the grounds. Also, when the resonance frequency f1 of the first radiation electrode 3 or the resonance frequency f2 of the second radiation electrode 4 is deviated from a set frequency because of the problem such as working accuracy, as in the case described above, a frequency adjustment for varying the resonance frequencies f1 and f2 toward a predetermined frequencies may be performed by means of trimming or the like.

Hereinafter, a second embodiment of the present invention will be described. This second embodiment is characterized in that the quantity of magnetic-field coupling between the high current regions X1 and X2 is equivalently set, by providing a meander-shaped pattern 18 which short-circuits a power supply terminal 5 and a ground short-circuit terminal 6, as shown in FIG. 9, instead of a meander-shaped pattern 9 as shown in the first embodiment, and by variably adjusting the magnitude of the inductance component L2 of the conductive pattern 8. Other constructions are the same as those of the first embodiment. In the descriptions of this second embodiment, the same components as those of the first embodiment have been given the same reference numerals, and repeated descriptions of the parts in common therebetween will be omitted.

In this second embodiment, as described above, there is provided the meander-shaped pattern 18 which short-circuits the power supply terminal 5 and the ground short-circuit terminal 6. By this meander-shaped pattern 18, there is formed a current path which leads from the high current region X1 of the first radiation electrode 3 to the high current region X2 of the second radiation electrode 4 via this meander-shaped pattern 18. The meander-shaped pattern 18 can perform the function of the electrode pattern in a matching circuit.

In the second embodiment, by variably adjusting the spacing H2 between the high current regions X1 and X2, as well as by variable adjusting the magnitude of the inductance component L2 of the meander-shaped pattern 18, the amount of the current flowing through the above-described current path is variably adjusted. Thereby, the quantity of the magnetic-field coupling between the high current regions X1 and X2 is set to a condition suited for the dual resonance.

As described above, when the present inventors performed an adjustment and setting of the quantity of the magnetic-field coupling between the high current regions X1 and X2, utilizing the inductance component L2 of the meander-shaped pattern 18, a very interesting phenomenon was found in the experiments.

Figure 10A:
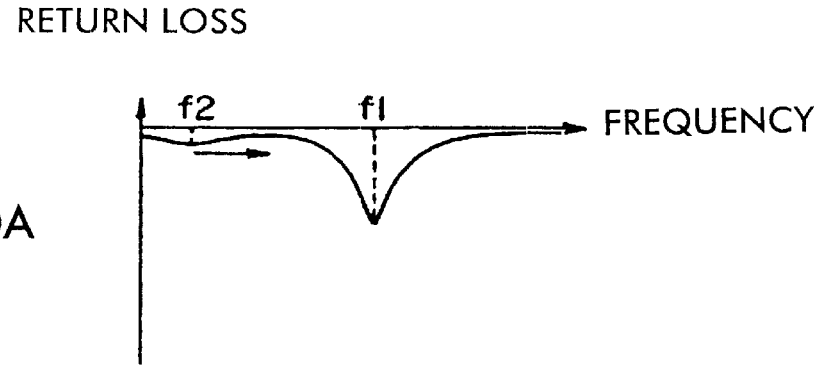
Figure 10B:
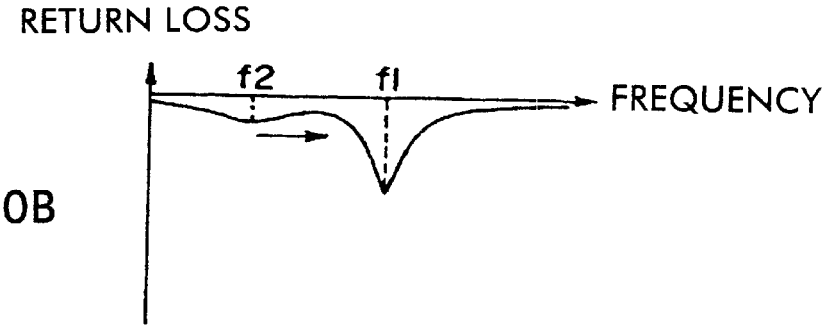
Figure 10C:
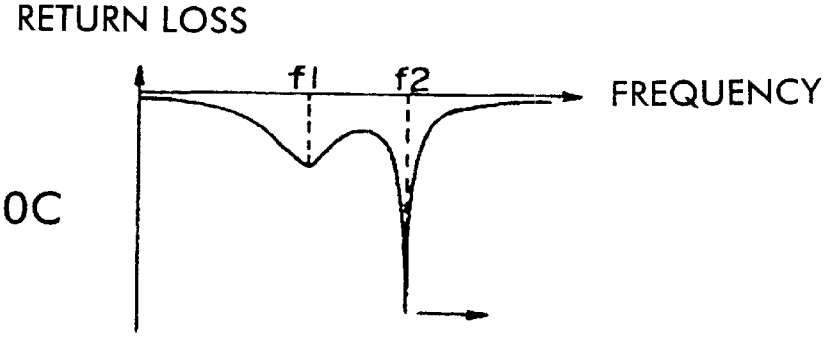
Figure 10D:
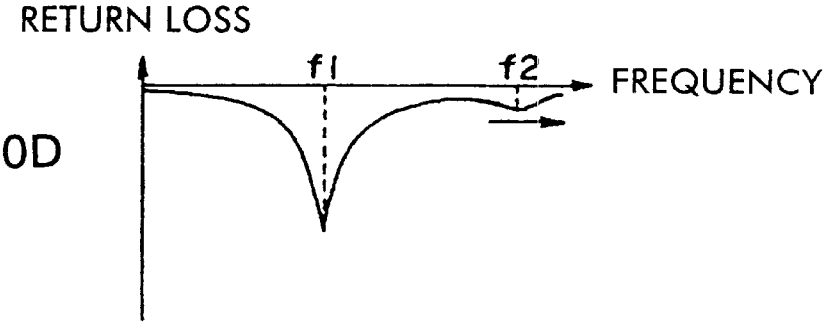

The interesting phenomenon is such that, in the state wherein the magnitude of the inductance component L2 of the meander-shaped pattern 18 is in a condition suited for the dual resonance, for example, as shown in FIGS. 10A through 10D, when the resonance frequency f2 of the second radiation electrode 4 is varied toward the high frequency side by varying the magnitude of the inductance component of the second radiation electrode 4 alone, as illustrated in FIGS. 10C and 10D, a superior dual-resonance state is achieved which allows the widening of the frequency band, immediately after the high-low relation between the resonance frequency f1 of the first radiation electrode 3 and the resonance frequency f2 of the second radiation electrode 4 has been reversed.

Figure 11A:
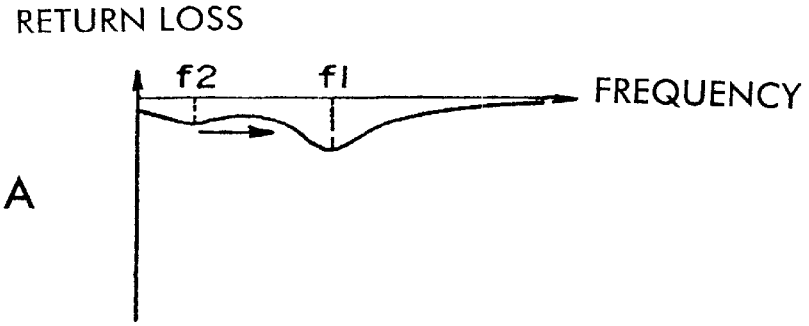
Figure 11B:
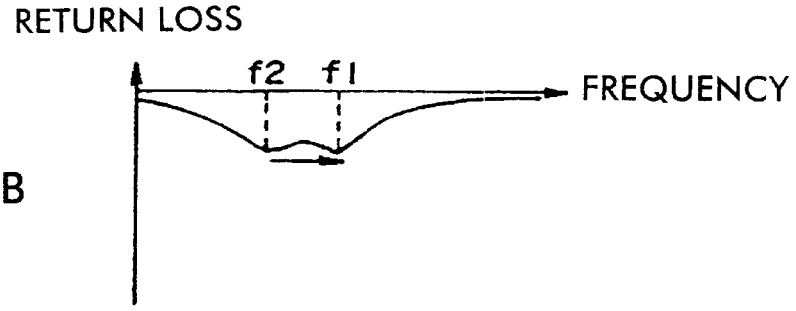
Figure 11C:
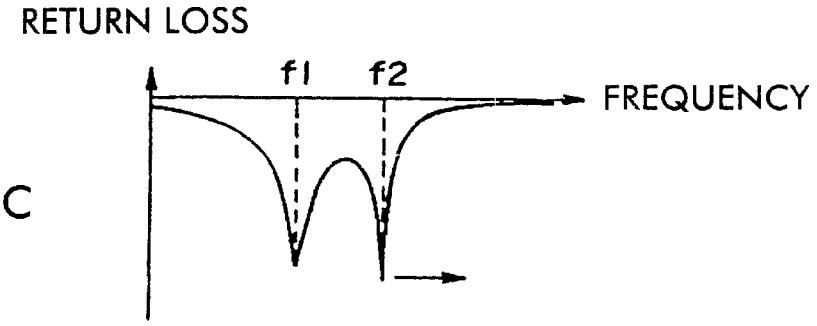
Figure 11D:
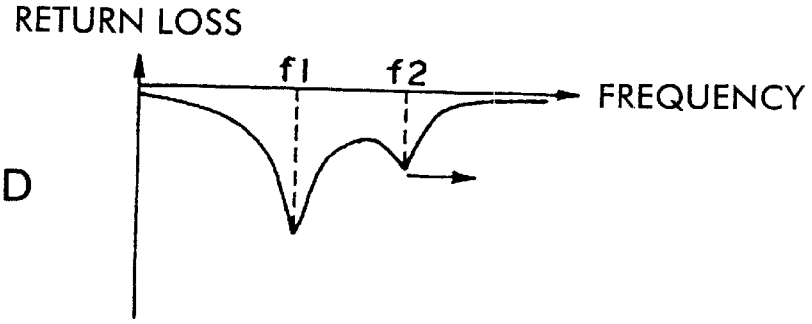
Figure 12A:
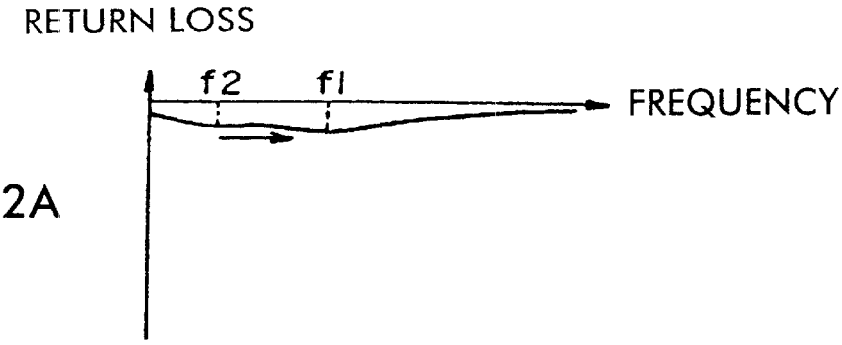
Figure 12B:
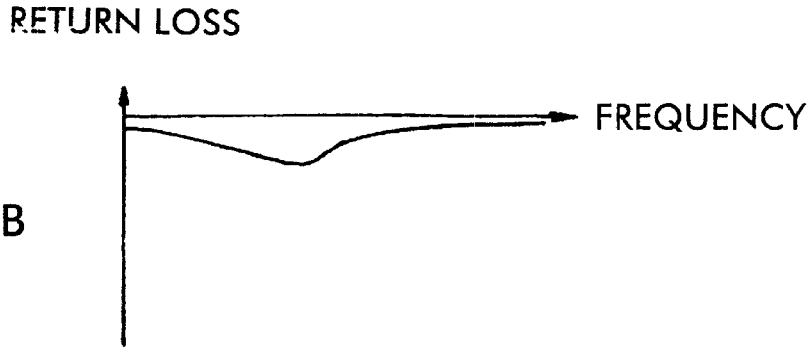
Figure 12C:
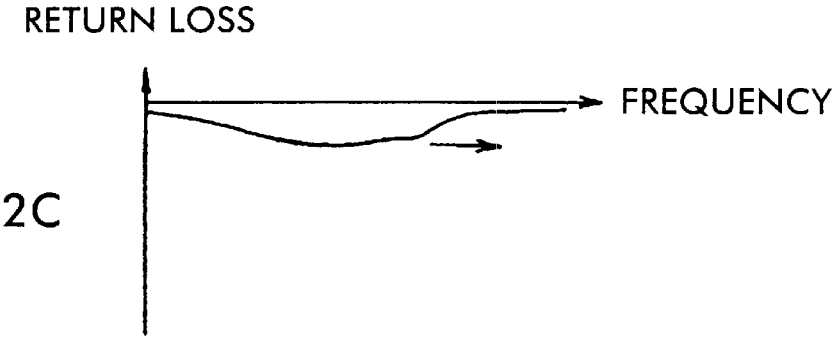
Figure 12D:
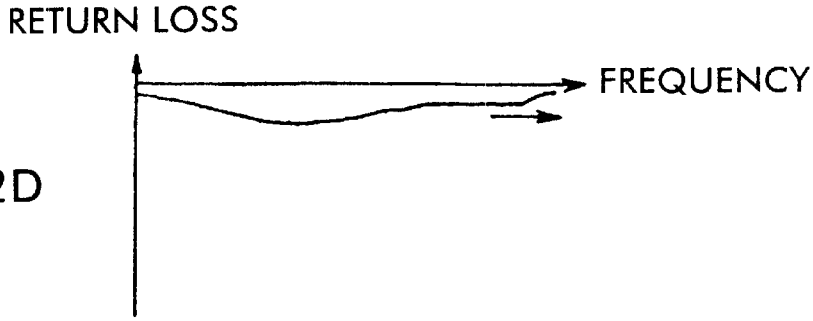

Even when the magnitude of the inductance component L2 of the meander-shaped pattern 18 is slightly varied in the "larger" direction than in the case shown in FIGS. 10A through 10D (of course, in this case also, the magnitude of the inductance component L2 is in a condition suited for the dual resonance), a similar phenomenon to the above-described case is observed, as shown in FIGS. 11A through 11D. As shown in FIGS. 11C and 11D, a superior dual-resonance state which allows the widening of the frequency band is attained, with the high-low relation between the resonance frequency f1 of the first radiation electrode 3 and the resonance frequency f2 of the second radiation electrode 4 reversed.

In the second embodiment, by utilizing not only the spacing H2 between the high current regions X1 and X2, but also the inductance component L2 of the meander-shaped pattern 18, the quantity of the magnetic-field coupling between the high current regions X1 and X2 is set to a condition suited for the dual resonance, and thereby superior return loss characteristics are obtained. As a result, the above-described phenomenon occurs and the resonance frequency f1 of the first radiation electrode 3 becomes lower than the resonance frequency f2 of the second radiation electrode 4.

When the magnitude of the inductance component L2 of the meander-shaped pattern 18 is larger than the condition suited for the dual resonance, each of the resonance waves of the first radiation electrode 3 and the second radiation electrode 4 attenuates to a very small magnitude such as not to be discriminated, as shown in FIGS. 12A through 12D.

In accordance with the second embodiment, the quantity of magnetic-field coupling between the high current regions X1 and X2 is set to a condition suited for the dual resonance, by providing a meander-shaped pattern 18 which short-circuits the power supply terminal 5 and the ground short-circuit terminal 6, instead of the meander-shaped pattern 9 shown in the first embodiment, and by variably adjusting the magnitude of the inductance component L2 of the meander-shaped pattern 18 as well as the spacing H2 between the high current regions X1 and X2, Hence, it is possible to easily attain superior return loss characteristics in the dual resonance, and to realize the widening of the frequency band, improving the antenna characteristics, as in the case of the first embodiment. Of course, it is also possible to obtain superior effects similar to those of the above-described first embodiment, such as an effect of improving the degree of flexibility in the design, and effect of reducing the design cost and consequently an effect of reducing the production cost of the surface-mounted type antenna 1.

Furthermore, as shown in the second embodiment, by utilizing the meander-shaped pattern 18 which short-circuits the power supply terminal 5 and the ground short-circuit terminal 6, the quantity of the magnetic-field coupling between the high current regions X1 and X2 is set to a condition suited for the dual resonance, thereby a unique frequency characteristic can be obtained wherein the resonance frequency f1 of the first radiation electrode 3 becomes lower than the resonance frequency f2 of the second radiation electrode 4, in the frequency band of a dual resonance.

Hereinafter, a third embodiment of the present invention will be described. This third embodiment is characterized in that, unlike the above-described embodiments, the open ends 3*a* and 4*a*, which are capacitive-coupling portions between the first radiation electrode 3 and the second radiation electrode 4 and the grounds, respectively, are not formed on the same side surface of the dielectric substrate 2, but, as shown in FIGS. 13A through 13C, the open end 3*a* of the first radiation electrode 3 and the open end 4*a* of the second radiation electrode 4 are formed on mutually different planes of the dielectric substrate 2. Other constructions are the same as those of the above-described embodiments. The same components as those of the above-described embodiments have been given the same reference numerals, and repeated descriptions of the parts in common therebetween will be omitted.

In the third embodiment, as illustrated in FIGS. 13A through 13C, narrow patterns extend from the mutually adjacent strong electric-field regions Z1 and Z2 of the first radiation electrode 3 and the second radiation electrode 4 to mutually different side surfaces of the dielectric substrate 2, and the extending tips thereof constitute open ends 3*a* and 4*a*, respectively.

In the third embodiment, in addition to that similar effects to those of the above-described embodiments can be obtained, the open ends 3*a* and 4*a* of the first radiation electrode 3 and the second radiation electrode 4 are formed on mutually different planes of the dielectric substrate 2, and hence it is possible to more reliably prevent an excessive increase in the quantity of the electric-field coupling between the strong electric-field regions Z1 and Z2, the excessive increase in the quantity of the electric-field coupling inhibiting a dual resonance of the first radiation electrode 3 and the second radiation electrode 4. In addition, as in the cases of the above-described embodiments, since the capacitances between the above-described open ends 3*a* and 4*a* and the grounds are variably adjusted and set to conditions suited for the dual resonance, a superior dual-resonance state can be achieved more easily.

As indicated by the dotted lines in FIG. 13A, open ends 3*a*', 3*a*", or the like may be formed in addition to the open end 3*a* of the narrow pattern, which is extended from the strong electric-field region Z1 of the first radiation electrode 3.

Hereinafter, a fourth embodiment of the present invention will be described. This fourth embodiment is characterized in that a plurality of second radiation electrodes 4 are formed, as shown in FIG. 14. Other constructions are the same as those of the above-described embodiments. In the descriptions of this fourth embodiment, the same components as those of the above-described embodiments have been given the same reference numerals, and repeated descriptions of the parts in common therebetween will be omitted.

In the example shown in FIG. 14, two second radiation electrodes 4, that is, a first second radiation electrode 4A and a second second radiation electrode 4B are formed on the top surface 2*a* of the dielectric substrate 2, together with the first radiation electrode 3. The first second radiation electrode 4A is juxtaposed with the first radiation electrode 3 with a space therebetween. As in the cases of the above-described embodiments, the strong electric-field region Z2 of the first second radiation electrode 4A and the strong electric-field region Z1 of the first radiation electrode 3 are formed adjacent to each other with a space therebetween, and simultaneously the high current region X2 of the first second radiation electrode 4A and the high current region X1 of the first radiation electrode 3 are formed adjacent to each other with a space therebetween.

A ground short circuit terminal 6A formed on the side surface 2*b* is connected to the high current region X2 on one end side of the first second radiation electrode 4A. The open end 4*a* of a narrow pattern which extends from the strong electric-field region Z2 on the other end side of the first second radiation electrode 4A to the side surface 2*d* of the dielectric substrate 2, is disposed so as to be opposed to a fixed electrode 12, which is equivalent to ground, with a spacing therebetween. The spacing between the open end 4*a* and the fixed electrode 12 is formed narrow so as to provide the space between the open end 4*a* and the ground with a large capacitance.

Furthermore, a second second radiation electrode 4B is juxtaposed with the first power second electrode 4A with a space therebetween, and as in the case described above, the strong electric-field regions Z2 and Z2' of the first second radiation electrode 4A and the second second radiation electrode 4B are formed adjacent to each other with a space therebetween, while the high current regions X2 and X2' of the first second radiation electrode 4A and the second second radiation electrode 4B are formed adjacent to each other with a space therebetween. A ground short-circuit terminal 6B formed on the side surface 2*b* is connected to the high current region X2' on one end side of the second second radiation electrode 4B. An open end 4*a*' of a narrow pattern which extends from the strong electric-field region Z2' on the other end side of the second second radiation electrode 4B to the side surface 2*c* of the dielectric substrate 2, is also arranged so as to provide the space between the open end 4*a* and ground with a large capacitance, as in the case of the above-described open end 4*a* of the first second radiation electrode 4A.

In the fourth embodiment also, as in the cases of the above-described embodiments, both the quantity of the electric-field coupling between the strong electric-field regions Z1 and Z2 of the first radiation electrode 3 and the first second radiation electrode 4A, and the quantity of the magnetic-field coupling between the high current regions X1 and X2 of these radiation electrodes are variably adjusted and set to conditions suited for the dual resonance. Simultaneously, both the quantity of the electric-field coupling between the strong electric-field regions Z2 and Z2' of the first second radiation electrode 4A and the second second radiation electrode 4B, and the quantity of the magnetic-field coupling between the high current regions X2 and X2' are variably adjusted and set to conditions suited for the dual resonance.

In accordance with the fourth embodiment, in addition to that similar effects to those of the above-described embodiments can be obtained, even when a plurality of second radiation electrodes 4 are formed, by providing a similar construction to that of the above-described embodiments, a superior dual resonance state between the first radiation electrode 3 and the first second radiation electrode 4A, a superior dual resonance state between the first radiation electrode 3 and the second second radiation electrode 4B, or a superior triple multiple-resonance state among the first radiation electrode 3, the first second radiation electrode 4A, and the second second radiation electrode 4B can be achieved easily and stably. This allows further widening of the frequency band and a further improvement in the antenna characteristics.

In the fourth embodiment, the open end 3*a* of the first radiation electrode 3 is formed on the side surface 2*d* of the dielectric substrate 2, but, as indicated by the dotted lines in FIG. 14, a narrow pattern may be extended from the strong electric-field region Z1 of the first radiation electrode 3 to the side surface 2*e* so that the extending tip thereof may be used as the open end 3*a*.

Hereinafter, a fifth embodiment of the present invention will be described. This fifth embodiment is characterized in that, unlike the above-described embodiments, a signal is not directly supplied from a signal supply source 7 side to the first radiation electrode 3, but a signal is supplied to the first radiation electrode 3 by means of capacitive power supply. Other constructions are the same as those of the above-described embodiments. In the descriptions of this fifth embodiment, the same components as those of the above-described embodiments have been given the same reference numerals, and repeated descriptions of the parts in common therebetween will be omitted.

In the fifth embodiment, for example, as indicated by the solid lines in FIG. 15, the tip of the power supply terminal 5 on the side surface 2*d* of the dielectric substrate 2 and the open end 3*a* of the strong electric-field region Z1 on one end side of the first radiation electrode 3 are disposed so as to be opposed to each other with a spacing therebetween. A signal is capacitively coupled from the power supply terminal 5 to the first radiation electrode 3. Here, a ground short-circuit terminal 20 is connected to the high current region X1 on the other side of the first radiation electrode 3. This ground short-circuit terminal 20 is disposed adjacent to the ground short-circuit terminal 6 of the second radiation electrode 4 with a spacing therebetween.

Even in such a capacitive power supply type surface-mounted type antenna 1, as in the cases of the above-described embodiments, the strong electric-field region Z1 of the first radiation electrode 3 and the strong electric-field region Z2 of the second radiation electrode 4 are disposed adjacent to each other, and simultaneously the high current region X1 of the first radiation electrode 3 and the high current region X2 of the second radiation electrode 4 are disposed adjacent to each other.

Although not shown in the figure, in the fifth embodiment, there is provided any one of a pattern for inductance component addition like the meander-shaped pattern 9 of the conductive pattern 8 as shown in FIG. 1, which is branched off from the ground short-circuit terminal 20 and which is connected to the ground, and a pattern for inductance component addition like the meander-shaped pattern 18 as shown in FIG. 9, which short-circuits the ground short-circuit terminal 20 and the ground short-circuit terminal 6.

In the fifth embodiment also, the spacing H1 between the strong electric-field regions Z1 and Z2, the spacing H2 between the high current regions X1 and X2, and the magnitude of the inductance component of the pattern for inductance component addition are adjusted and set so that both the quantity of the electric-field coupling between the strong electric-field regions Z1 and Z2, and the quantity of the magnetic-field coupling between the high current regions X1 and X2 come into conditions suited for the dual resonance.

In accordance with the fifth embodiment, in the capacitive power supply type surface-mounted antenna 1 also, as in the cases of the above-described embodiments, by setting both the quantity of the electric-field coupling between the strong electric-field regions Z1 and Z2, and the quantity of the magnetic-field coupling between the high current regions X1 and X2 to conditions suited for the dual resonance, similar effects to those of the above-described embodiments can be obtained, thereby providing a surface-mounted type antenna 1 having high-reliability antenna characteristics.

In the fifth embodiment, the open end 4*a* of the second radiation electrode 4 is formed on the side surface 2*d* of the dielectric substrate 2, but, as indicated by the dotted lines in FIG. 15, a narrow pattern may be extended from the strong electric-field region Z2 of the second radiation electrode 4 to the side surface 2C of the dielectric substrate 2 so that the extending tip thereof may be used as the open end 4*a*. Also, the power supply terminal 5 is formed on the side surface 2*d* of the dielectric substrate 2, but, for example, as indicated by dotted lines in FIG. 15, the power supply terminal 5 may be formed at a position on the side surface 2*e* of the dielectric substrate 2, the position being opposed to the strong electric-field region Z1 of the first radiation electrode 3. Furthermore, in the example illustrated in FIG. 15, although only one second radiation electrodes 4 is formed, a plurality of second radiation electrode 4 may be formed, as shown in the above-described fourth embodiment. Even if a capacitive power supply type having a plurality of second radiation electrodes 4 is used, superior effects similar to those of the above-described embodiments can be obtained by setting the quantities of the electric-field coupling and the magnetic-field coupling so as to allow a superior dual-resonance state to be achieved, as in the case of the above-described embodiments.

Hereinafter, a sixth embodiment of the present invention will be described. In this sixth embodiment, an example of a communication device will be explained. The communication device shown in the sixth embodiment is a portable radio communication device 25. Such as a cellular phone or mobile radio. This portable radio communication device 25 has a circuit board 27 incorporated in a case 26 thereof. As illustrated in FIG. 16, a transmitting circuit 28, which is a signal supply source, a receiving circuit 29, and a transmission/reception switching circuit 30 are formed on the circuit board 27.

The communication device in accordance with the sixth embodiment is characterized in that a surface-mounted type antenna 1 which has a unique construction as shown in the above-described embodiments is mounted on the above-mentioned circuit board 27. The surface-mounted type antenna 1 is conductively connected to the transmitting circuit 28 and the receiving circuit 29 via the transmission/reception switching circuit 30. In this radio communication device 25, the operation of signal transmission/reception is smoothly performed by the switching operation of the transmission/reception switching circuit 30.

In accordance with the sixth embodiment, since the radio communication device 25 is equipped with a surface-mounted type antenna as shown in the above-described embodiments, it is easy to meet a predetermined antenna characteristic condition such as the widening of the frequency for signal transmission/reception, which allows a communication device having high-reliability antenna characteristics to be provided.

The present invention is not limited to the above-described embodiments, but various embodiments may be adopted. In the above-described embodiments, for example, the space S between the first radiation electrode 3 and the second radiation electrode 4 is arranged so as to diverge from the high current region X1 and X2 sides to the strong electric-field region Z1 and Z2 sides, and the mutually adjacent side edges of the first radiation electrode 3 and the second radiation electrode 4 are formed into curved lines from the high current region X1 and X2 sides to the strong electric-field region Z1 and Z2 sides. However, for example, any one or both of the mutually adjacent side edges of the power supplied radiation electrode 3 and the second radiation electrode 4 may be formed into straight lines.

Moreover, in the above-described embodiments, the space S between the first radiation electrode 3 and the second radiation electrode 4 is arranged so as to continuously diverge from the high current region X1 and X2 sides to the strong electric-field region Z1 and Z2 sides, but the space S may instead be arranged so as to stepwise diverge from the high current region X1 and X2 sides to the strong electric-field region Z1 and Z2 sides.

Also, in the above-described embodiments, the dielectric substrate 2 is formed as a rectangular parallelepiped, but the shape of the dielectric substrate 2 is not limited to the rectangular parallelepiped. The dielectric substrate 2 may take various shapes. The shape of each of the first radiation electrode 3 and the second radiation electrode 4 is not restricted to the shapes shown in the above-described embodiments either. For example, although the first radiation electrode 3 and the second radiation electrode 4 as shown in the above-described embodiments, have patterns for frequency adjustment (slits 14 and 15) formed therein, these patterns for frequency adjustment may be omitted.

In the above-described sixth embodiment, descriptions have been made of a portable radio communication device shown in FIG. 16 by way of example. However, the present invention is not limited to the communication device shown in FIG. 16. For example, the present invention may also be applied to stationary radio communication devices.

As described hereinbefore, in accordance with the present invention, the strong electric-field regions of the first radiation electrode and the second radiation electrode are disposed adjacent to each other with a spacing therebetween, simultaneously the high current regions of these radiation electrodes are disposed adjacent to each other with a spacing therebetween, and the quantity of the electric-field coupling between the strong electric-field regions and the quantity of the magnetic-field coupling between the high current regions, are variably adjusted independently of each other. By thus variably adjusting each of the quantities of the electric-field coupling and the magnetic-field coupling, both the quantities of the electric-field coupling and the magnetic-field coupling are adjusted, and the reflection loss in the dual resonance of the first radiation electrode and the second radiation electrode is set to be not more than a predetermined value within the range of a set frequency, that is, to a condition which meets a predetermined antenna characteristic condition. This allows superior return loss (reflection loss) characteristics to be obtained, and enables the widening of the frequency band to be easily realized.

When the quantity of the electric-field coupling between the strong electric-field regions of the first radiation electrode and the second radiation electrode is variably adjusted, by making variable the spacing between the strong electric-field regions of these radiation electrodes, and when the quantity of the magnetic-field coupling between the high current regions of these radiation electrodes is variably adjusted, by making variable the spacing between the high current regions of these radiation electrodes, the control of the quantity of the electric-field coupling between the strong electric-field regions and the quantity of the magnetic-field coupling between the high current regions becomes easy, by variably adjusting the spacing between the strong electric-field regions and the spacing between the high current regions, without maintaining the uniform width of the space between the first radiation electrode and the second radiation electrode. This allows both the quantities of the electric-field coupling and the magnetic-field coupling to be set to conditions suited for the dual resonance.

By performing an adjustment and setting in this way, the space between the first radiation electrode and the second radiation electrode diverges from the high current region side to the strong electric-field region side. In other words, when the space between the first radiation electrode and the second radiation electrode diverges from the high current region side to the strong electric-field region side, both the quantities of the electric-field coupling and the magnetic-field coupling can be set to conditions suited for the dual resonance. Thereby, it is possible to provide a surface-mounted type antenna which allows a superior dual-resonance state to be achieved, which allows the widening of the frequency band to be realized, and which enables the miniaturization thereof.

When the quantity of the electric-field coupling between the strong electric-field regions of the first radiation electrode and the second radiation electrode is relatively variably adjusted, by variably adjusting the capacitance between the open end of the first radiation electrode and ground, and the capacitance between the open end of the second radiation electrode and ground, it is possible to reliably prevent the quantity of the electric-field coupling from an excessive increase, which inhibits a dual resonance, and to set the quantity of the electric-field coupling between the strong electric-field regions of the radiation electrodes to a condition suited for the dual resonance. This leads to a more superior dual-resonance state.

When the capacitive coupling portion between the open end of the strong electric-field region of the first radiation electrode and ground thereof, and the capacitive coupling portion between the open end of the strong electric-field region of the second radiation electrode and ground thereof, are formed on different surfaces from each other, it is possible to prevent more reliably the above-described excessive increase in the quantity of the electric-field coupling, the excessive increase in the quantity of the electric-field coupling inhibiting a dual resonance. This results in a very superior dual-resonance state.

When a conductive pattern is formed which is branched off from the power supply terminal or the ground short-circuit terminal of the first radiation electrode and which is connected to ground, a pattern for inductance component addition is interposed in this conductive pattern, or the power supply terminal or the ground short-circuit of the first radiation electrode and the ground short-circuit terminal of the second radiation electrode are juxtaposed with a spacing therebetween, the power supply terminal or the ground short-circuit of the first radiation electrode, and the ground short-circuit terminal of the second radiation electrode are short-circuited by utilizing the pattern for inductance component addition, and the quantity of the magnetic-field coupling between the high current regions of the first radiation electrode and the second radiation electrode is equivalently variably adjusted, by making variable the magnitude of the inductance component of the pattern for inductance component addition. Thereby, it is possible to variably adjust the quantity of the magnetic-field coupling between the high current regions of the first radiation electrode and the second radiation electrode without affecting the quantity of the magnetic-field coupling. This allows the degree of flexibility of the design of a surface-mounted type antenna to be improved, and enables the design of a surface-mounted type antenna to be conducted easily and in a short time, which results in reduced design cost and consequently in reduced production cost of the surface-mounted type antenna.

When the above-described pattern for inductance component addition are made to also perform the function of an electrode pattern which constitute a matching circuit, not only the quantity of the magnetic-field coupling between the high current regions of the first radiation electrode and the second radiation electrode can be variably adjusted, but also the matching can be achieved by the pattern for inductance component addition, as described above. It is, therefore, unnecessary to provide a matching circuit, for example, on the circuit board of a communication board. This allows a reduction in the number of components of a communication device, which leads to a reduction in the production cost of the communication device. In addition, by forming a pattern for inductance component addition, which constitutes an electrode pattern, on the surface of the dielectric substrate, a high power can be provided for the surface-mounted type antenna 1.

In the surface-mounted type antenna wherein, as describe above, the quantity of the magnetic-field coupling between the high current regions of the first radiation electrode and the second radiation electrode can be variably adjusted and set, by utilizing the pattern for inductance component addition, which short-circuits the power supply terminal or the ground short-circuit terminal of the first radiation electrode and the ground short-circuit terminal of the second radiation electrode, a unique frequency characteristics wherein the resonance frequency of the first radiation electrode becomes lower than the resonance frequency of the second radiation electrode, in the frequency band of a dual resonance, can be obtained. This constitutes an effective means when it is necessary to assign the second radiation electrode to a high-frequency resonance and to assign the first radiation electrode to a low-frequency resonance.

The communication device including a surface-mounted type antenna which has been adjusted and set, can implement a communication device having high-reliability antenna characteristics, since it is equipped with a superior surface-mounted type antenna as described above.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A method for adjusting and setting a dual resonance frequency of a surface-mounted type antenna which includes a dielectric substrate, a first radiation electrode to which power is supplied and which is formed on a top surface of the substrate opposed to a mounting bottom-surface of said dielectric substrate, and a second radiation electrode to which power is not directly supplied and which is juxtaposed with said first radiation electrode on said dielectric substrate with a space therebetween, said method comprising:

arranging said first and second radiation electrodes directly on the top surface of the dielectric substrate;

arranging said first radiation electrode and said second radiation electrode so that strong electric-field regions of said first radiation electrode and said second radiation electrode wherein electric fields of these radiation electrodes are each the strongest, are adjacent to each other, and so that the strong electric-field regions of these radiation electrodes thereby come into an electric-field coupling;

simultaneously arranging said first radiation electrode and said second radiation electrode so that high current regions of said first radiation electrode and said second radiation electrode wherein the currents of these radiation electrodes are each the highest, are adjacent to each other, and so that the high current regions of these radiation electrodes thereby come into a magnetic-field coupling;

variably adjusting each of the electric-field coupling between the strong electric-field regions of said first radiation electrode and said second radiation electrode, and the magnetic-field coupling between the high current regions of said first radiation electrode and said second radiation electrode; and setting a reflection loss in the dual resonance of said first radiation electrode and said second radiation electrode to a value not higher than a predetermined value within the range of a set frequency, by adjusting both the electric-field coupling and the magnetic-field coupling.

2. The method for adjusting and setting a dual-resonance frequency of a surface-mounted type antenna as claimed in claim 1, said method further comprising:

variably adjusting the electric-field coupling between the strong electric-field regions of the first radiation electrode and the second radiation electrode, by making variable the spacing between the strong electric-field regions of the first radiation electrode and the second radiation electrode.

3. The method for adjusting and setting a dual-resonance frequency of a surface-mounted type antenna as claimed in claim 1, said method further comprising:

providing the first radiation electrode with a capacitance between an open end thereof which is a strong electric-field region thereof on one end side thereof and ground, and connecting a power supply terminal or a ground short-circuit terminal to a high current region thereof on another end side thereof;

providing the second radiation electrode with a capacitance between an open end thereof which is a strong electric-field region thereof on one end side thereof and ground, and connecting a ground short-circuit terminal to a high current region thereof on another end side thereof; and relatively variably adjusting the electric-field coupling between the strong electric-field regions of the first radiation electrode and the second radiation electrode, by variably adjusting the capacitance between the open end of the first radiation electrode and ground, and the capacitance between the open end of the second radiation electrode and ground.

4. The method for adjusting and setting a dual-resonance frequency of a surface-mounted type antenna as claimed in claim 2, said method further comprising:

providing the first radiation electrode with a capacitance between an open end thereof which is a strong electric-field region thereof on one end side thereof and ground, and connecting a power supply terminal or a ground short-circuit terminal to a high current region thereof on another end side thereof;

providing the second radiation electrode with a capacitance between an open end thereof which is a strong electric-field region thereof on one end side thereof and ground, and connecting a ground short-circuit terminal to a high current region thereof on another end side thereof; and relatively variably adjusting the electric-field coupling between the strong electric-field regions of the first radiation electrode and the second radiation electrode, by variably adjusting the capacitance between the open end of the first radiation electrode and ground, and the capacitance between the open end of the second radiation electrode and ground.

5. A method for adjusting and setting a dual-resonance frequency of a surface-mounted type antenna as claimed in claim 3, said method further comprising:

forming said dielectric substrate as a rectangular parallelepiped; and forming a capacitive coupling portion between the open end of the strong electric-field region of the first radiation electrode and ground thereof, and a capacitive coupling portion between the open end of the strong electric-field region of the second radiation electrode and ground thereof, on mutually different surfaces of said dielectric substrate.

6. A method for adjusting and setting a dual-resonance frequency of a surface-mounted type antenna as claimed in claim 4, said method further comprising:

forming said dielectric substrate as a rectangular parallelepiped; and forming a capacitive coupling portion between the open end of the strong electric-field region of the first radiation electrode and ground thereof, and a capacitive coupling portion between the open end of the strong electric-field region of the second radiation electrode and ground thereof, on mutually different surfaces of said dielectric substrate.

7. A method for adjusting and setting a dual-resonance frequency of a surface-mounted type antenna as claimed in claim 1, said method further comprising:

variably adjusting the magnetic-field coupling between the high current regions of the first radiation electrode and the second radiation electrode, by making variable a spacing between the high current regions of the first radiation electrode and the second radiation electrode.

8. A method for adjusting and setting a dual-resonance frequency of a surface-mounted type antenna as claimed in claim 2, said method further comprising:

variably adjusting the magnetic-field coupling between the high current regions of the first radiation electrode and the second radiation electrode, by making variable a spacing between the high current regions of the first radiation electrode and the second radiation electrode.

9. A method for adjusting and setting a dual-resonance frequency of a surface-mounted type antenna as claimed in claim 3, said method further comprising:

variably adjusting the magnetic-field coupling between the high current regions of the first radiation electrode and a second radiation electrode, by making variable the spacing between the high current regions of the first radiation electrode and the second radiation electrode.

10. A method for adjusting and setting a dual-resonance frequency of a surface-mounted type antenna as claimed in claim 5, said method further comprising:

variably adjusting the magnetic-field coupling between the high current regions of the first radiation electrode and the second radiation electrode, by making variable a spacing between the high current regions of the first radiation electrode and the second radiation electrode.

11. A method for adjusting and setting a dual-resonance frequency of a surface-mounted type antenna as claimed in claim 3, said method further comprising:

forming a conductive pattern which is branched off from the power supply terminal or the ground short-circuit terminal of the first radiation electrode, and which is connected to ground;

interposing a pattern for inductance component addition in said conductive pattern;

forming a current path which leads from said high current region of the first radiation electrode to said high current region of the second radiation electrode via said conductive pattern, ground, and the ground short-circuit terminal of the second radiation electrode; and equivalently variably adjusting the magnetic-field coupling between the high current regions of the first radiation electrode and the second radiation electrode, by making variable a magnitude of an inductance component of said pattern for inductance component addition.

12. A method for adjusting and setting a dual-resonance frequency of a surface-mounted type antenna as claimed in claim 5, said method further comprising:

forming a conductive pattern which is branched off from the power supply terminal or the ground short-circuit terminal of the first radiation electrode, and which is connected to ground;

interposing a pattern for inductance component addition in said conductive pattern;

forming a current path which leads from said high current region of the first radiation electrode to said high current region of the second radiation electrode via said conductive pattern, ground, and the ground short-circuit terminal of the second radiation electrode; and equivalently variably adjusting the magnetic-field coupling between the high current regions of the first radiation electrode and the second radiation electrode, by making variable a magnitude of an inductance component of said pattern for inductance component addition.

13. A method for adjusting and setting a dual-resonance frequency of a surface-mounted type antenna as claimed in claim 7, said method further comprising:

forming a conductive pattern which is branched off from the power supply terminal or the ground short-circuit terminal of the first radiation electrode, and which is connected to ground;

interposing a pattern for inductance component addition in said conductive pattern;

forming a current path which leads from said high current region of the first radiation electrode to said high current region of the second radiation electrode via said conductive pattern, ground, and the ground short-circuit terminal of the second radiation electrode; and equivalently variably adjusting the magnetic-field coupling between the high current regions of the first radiation electrode and the second radiation electrode, by making variable a magnitude of an inductance component of said pattern for inductance component addition.

14. A method for adjusting and setting a dual-resonance frequency of a surface-mounted type antenna as claimed in claim 3, said method further comprising:

juxtaposing the power supply terminal or the ground short-circuit terminal of the first radiation electrode, and the ground short-circuit terminal of the second radiation electrode with a spacing therebetween;

short-circuiting said power supply terminal or said ground short-circuit terminal of the first radiation electrode, and said ground short-circuit terminal of the second radiation electrode, by utilizing a pattern for inductance component addition; and equivalently variably adjusting the magnetic-field coupling between the high current regions of the first radiation electrode and the second radiation electrode, by making variable a magnitude of an inductance component of said pattern for inductance component addition.

15. A method for adjusting and setting a dual-resonance frequency of a surface-mounted type antenna as claimed in claim 5, said method further comprising:

juxtaposing the power supply terminal or the ground short-circuit terminal of the first radiation electrode, and the ground short-circuit terminal of the second radiation electrode with a spacing therebetween;

short-circuiting said power supply terminal or said ground short-circuit terminal of the first radiation electrode, and said ground short-circuit terminal of the second radiation electrode, by utilizing a pattern for inductance component addition; and equivalently variably adjusting the magnetic-field coupling between the high current regions of the first radiation electrode and the second radiation electrode, by making variable a magnitude of an inductance component of said pattern for inductance component addition.

16. A method for adjusting and setting a dual-resonance frequency of a surface-mounted type antenna as claimed in claim 7, said method further comprising:

juxtaposing the power supply terminal or the ground short-circuit terminal of the first radiation electrode, and the ground short-circuit terminal of the second radiation electrode with a spacing therebetween;

short-circuiting said power supply terminal or said ground short-circuit terminal of the first radiation electrode, and said ground short-circuit terminal of the second radiation electrode, by utilizing a pattern for inductance component addition; and equivalently variably adjusting the magnetic-field coupling between the high current regions of the first radiation electrode and the second radiation electrode, by making variable a magnitude of an inductance component of said pattern for inductance component addition.

17. A method for adjusting and setting a dual-resonance frequency of a surface-mounted type antenna as claimed in claim 11, said method further comprising:

making the pattern for inductance component addition also perform a function of an electrode pattern which comprises a matching circuit.

18. A method for adjusting and setting a dual-resonance frequency of a surface-mounted type antenna as claimed in claim 14, said method further comprising:

making the pattern for inductance component addition also perform a function of an electrode pattern which comprises a matching circuit.

19. The method for adjusting and setting a dual-resonance frequency of a surface-mounted type antenna as claimed in claim 1, further comprising gradually increasing the space between the first and second radiation electrodes from one side to an opposite side of the dielectric substrate.

20. A surface-mounted type antenna comprising:

a dielectric substrate;

a first radiation electrode to which power is supplied disposed directly on a top surface of said dielectric substrate;

a second radiation electrode to which power is not directly supplied which is disposed adjacent to said first radiation electrode directly on said top surface of said dielectric substrate with a space therebetween;

strong electric-field regions of said first radiation electrode and the second radiation electrode wherein electric fields of these radiation electrodes are each the strongest, being disposed adjacent to each other with a spacing therebetween;

high current regions of said first radiation electrode and said second radiation electrode wherein currents of these radiation electrodes are each the highest, being disposed adjacent to each other with a spacing therebetween; and said space between said first radiation electrode and said second radiation electrode diverging from said high current regions to said strong electric-field regions.

21. The surface-mounted type antenna as claimed in claim 20, wherein:

a power supply terminal or a ground short-circuit terminal is connected to the high current region of said first radiation electrode;

a ground short-circuit terminal is connected to the high current region of said second radiation electrode;

said power supply terminal or said ground short-circuit terminal of the first radiation electrode and said ground short-circuit terminal of the second radiation electrode are juxtaposed with a spacing therebetween;

a pattern for inductance component addition which short-circuits the power supply terminal or the ground short-circuit terminal of said first radiation electrode and the ground short-circuit terminal of said second radiation electrode;

a magnitude of an inductance component of said pattern for inductance component addition is set to a value such as to allow a return loss characteristic of the dual resonance of said first radiation electrode and said second radiation electrode to be obtained, said return loss characteristic meeting a predetermined antenna characteristic condition; and a resonance frequency of the first radiation electrode is lower than a resonance frequency of the second radiation electrode, in a frequency band of dual resonance.

22. The surface-mounted type antenna as claimed in claim 20, further wherein the space between the first and second radiation electrodes gradually increases from one side to an opposite side of the dielectric substrate.

23. A communication device comprising:

a surface-mounted type antenna produced by adjusting and setting a dual-resonance frequency in accordance with a method for adjusting and setting a dual-resonance frequency of a surface-mounted type antenna, the surface-mounted type antenna comprising:

a dielectric substrate;

a first radiation electrode to which power is supplied disposed on a top surface of said dielectric substrate;

a second radiation electrode to which power is not directly supplied which is disposed adjacent to said first radiation electrode on said dielectric substrate with a space therebetween;

strong electric-field regions of said first radiation electrode and the second radiation electrode wherein electric fields of these radiation electrodes are each the strongest, being disposed adjacent to each other with a spacing therebetween;

high current regions of said first radiation electrode and said second radiation electrode wherein currents of these radiation electrodes are each the highest, being disposed adjacent to each other with a spacing therebetween; and said space between said first radiation electrode and said second radiation electrode diverging from said high current regions to said strong electric-field regions;

wherein the surface-mounted type antenna is produced by the method for adjusting and setting a dual-resonance frequency of the surface-mounted type antenna comprising the steps of:

arranging said first and second radiation electrodes directly on the top surface of the dielectric substrate;

arranging said first radiation electrode and said second radiation electrode so that strong electric-field regions of said first radiation electrode and said second radiation electrode wherein electric fields of these radiation electrodes are each the strongest, are adjacent to each other, and so that the strong electric-field regions of these radiation electrodes thereby come into an electric-field coupling;

simultaneously arranging said first radiation electrode and said second radiation electrode so that high current regions of said first radiation electrode and said second radiation electrode wherein the currents of these radiation electrodes are each the highest, are adjacent to each other, and so that the high current regions of these radiation electrodes thereby come into a magnetic-field coupling;

variably adjusting each of the electric-field coupling between the strong electric-field regions of said first radiation electrode and said second radiation electrode, and the magnetic-field coupling between the high current regions of said first radiation electrode and said second radiation electrode; and setting a reflection loss in the dual resonance of said first radiation electrode and said second radiation electrode to a value not higher than a predetermined value within the range of a set frequency, by adjusting both the electric-field coupling and the magnetic-field coupling.

24. The communication device of claim 23, further wherein:

a power supply terminal or a ground short-circuit terminal is connected to the high current region of said first radiation electrode;

a ground short-circuit terminal is connected to the high current region of said second radiation electrode;

said power supply terminal or said ground short-circuit terminal of the first radiation electrode and said ground short-circuit terminal of the second radiation electrode are juxtaposed with a spacing therebetween;

a pattern for inductance component addition which short-circuits the power supply terminal or the ground short-circuit terminal of said first radiation electrode and the ground short-circuit terminal of said second radiation electrode;

a magnitude of an inductance component of said pattern for inductance component addition is set to a value such as to allow a return loss characteristic of the dual resonance of said first radiation electrode and said second radiation electrode to be obtained, said return loss characteristic meeting a predetermined antenna characteristic condition; and a resonance frequency of the first radiation electrode is lower than a resonance frequency of the second radiation electrode, in a frequency band of dual resonance.

25. The communication device of claim 23, further wherein the surface-mounted antenna is produced by variably adjusting the electric-field coupling between the strong electric-field regions of the first radiation electrode and the second radiation electrode, by making variable the spacing between the strong electric-field regions of the first radiation electrode and the second radiation electrode.

26. The communication device of claim 23, further wherein the surface-mounted antenna is produced by:

providing the first radiation electrode with a capacitance between an open end thereof which is a strong electric-field region thereof on one end side thereof and ground, and connecting a power supply terminal or a ground short-circuit terminal to a high current region thereof on another end side thereof;

providing the second radiation electrode with a capacitance between an open end thereof which is a strong electric-field region thereof on one end side thereof and ground, and connecting a ground short-circuit terminal to a high current region thereof on another end side thereof; and relatively variably adjusting the electric-field coupling between the strong electric-field regions of the first radiation electrode and the second radiation electrode, by variably adjusting the capacitance between the open end of the first radiation electrode and ground, and the capacitance between the open end of the second radiation electrode and ground.

27. The communication device of claim 23, further wherein the surface-mounted antenna is produced by:

forming said dielectric substrate as a rectangular parallelepiped; and forming a capacitive coupling portion between the open end of the strong electric-field region of the first radiation electrode and ground thereof, and a capacitive coupling portion between the open end of the strong electric-field region of the second radiation electrode and ground thereof, on mutually different surfaces of said dielectric substrate.

28. The communication device of claim 23, further wherein the surface mounted antenna is produced by:

variably adjusting the magnetic-field coupling between the high current regions of the first radiation electrode and the second radiation electrode, by making variable the spacing between the high current regions of the first radiation electrode and the second radiation electrode.

29. The communication device of claim 24, further wherein the surface-mounted antenna is produced by:

forming a conductive pattern which is branched off from the power supply terminal or the ground short-circuit terminal of the first radiation electrode, and which is connected to ground;

interposing a pattern for inductance component addition in said conductive pattern;

forming a current path which leads from said high current region of the first radiation electrode to said high current region of the second radiation electrode via said conductive pattern, ground, and the ground short-circuit terminal of the second radiation electrode; and equivalently variably adjusting the magnetic-field coupling between the high current regions of the first radiation electrode and the second radiation electrode, by making variable a magnitude of an inductance component of said pattern for inductance component addition.

30. The communication device of claim 24, further wherein the surface-mounted antenna is produced by:

juxtaposing the power supply terminal or the ground short-circuit terminal of the first radiation electrode, and the ground short-circuit terminal of the second radiation electrode with a spacing therebetween;

short-circuiting said power supply terminal or said ground short-circuit terminal of the first radiation electrode, and said ground short-circuit terminal of the second radiation electrode, by utilizing a pattern for inductance component addition; and equivalently variably adjusting the magnetic-field coupling between the high current regions of the first radiation electrode and the second radiation electrode, by making variable a magnitude of an inductance component of said pattern for inductance component addition.

31. The communication device of claim 24, further wherein the surface-mounted antenna is produced by making the pattern for inductance component addition also perform the function of an electrode pattern which constitutes a matching circuit.

32. The communication device of claim 24, further wherein the surface-mounted antenna is produced by variably adjusting the electric-field coupling between the strong electric-field regions of the first radiation electrode and the second radiation electrode, by making variable the spacing between the strong electric-field regions of the first radiation electrode and the second radiation electrode.

33. The communication device of claim 24, further wherein the surface-mounted antenna is produced by:

providing the first radiation electrode with a capacitance between an open end thereof which is a strong electric-field region thereof on one end side thereof and ground, and connecting a power supply terminal or a ground short-circuit terminal to a high current region thereof on another end side thereof;

providing the second radiation electrode with a capacitance between an open end thereof which is a strong electric-field region thereof on one end side thereof and ground, and connecting a ground short-circuit terminal to a high current region thereof on another end side thereof; and relatively variably adjusting the electric-field coupling between the strong electric-field regions of the first radiation electrode and the second radiation electrode, by variably adjusting the capacitance between the open end of the first radiation electrode and ground, and the capacitance between the open end of the second radiation electrode and the ground.

34. The communication device of claim 24, further wherein the surface-mounted antenna is produced by:

forming said dielectric substrate as a rectangular parallelepiped; and forming a capacitive coupling portion between the open end of the strong electric-field region of the first radiation electrode and ground thereof, and a capacitive coupling portion between the open end of the strong electric-field region of the second radiation electrode and ground thereof, on mutually different surfaces of said dielectric substrate.

35. The communication device of claim 24, further wherein the surface-mounted antenna is produced by:

variably adjusting the magnetic-field coupling between the high current regions of the first radiation electrode and the second radiation electrode, by making variable the spacing between the high current regions of the first radiation electrode and the second radiation electrode.

36. The communication device of claim 23, further wherein the space between the first and second radiation electrodes gradually increases from one side to an opposite side of the dielectric substrate.

* * * * *